US008286728B2

(12) United States Patent
Veeningen

(10) Patent No.: US 8,286,728 B2
(45) Date of Patent: Oct. 16, 2012

(54) SYSTEM AND METHOD FOR COMMUNICATING ABOUT A WELLSITE

(75) Inventor: Daniel M. Veeningen, Houston, TX (US)

(73) Assignee: Intelliserv, LLC, Houston, TX (US)

( * ) Notice: Subject to any disclaimer, the term of this patent is extended or adjusted under 35 U.S.C. 154(b) by 380 days.

(21) Appl. No.: 12/751,350

(22) Filed: Mar. 31, 2010

(65) Prior Publication Data

US 2010/0243325 A1 Sep. 30, 2010

Related U.S. Application Data

(60) Provisional application No. 61/165,232, filed on Mar. 31, 2009.

(51) Int. Cl.
*E21B 19/16* (2006.01)

(52) U.S. Cl. ..... 175/40; 166/77.51; 340/853.1

(58) Field of Classification Search ..... 166/75.13, 166/77.51–77.53, 92.1, 94.1; 175/40, 321, 175/424; 340/853.1–856.4
See application file for complete search history.

(56) References Cited

U.S. PATENT DOCUMENTS

| | | | | |
|---|---|---|---|---|
| 6,670,880 | B1 | 12/2003 | Hall et al. | |
| 6,991,035 | B2 | 1/2006 | Hall et al. | |
| 7,198,118 | B2 | 4/2007 | Hall et al. | |
| 8,049,506 | B2 * | 11/2011 | Lazarev | 324/333 |
| 2004/0159425 | A1 * | 8/2004 | Webre et al. | 166/66 |
| 2005/0046586 | A1 * | 3/2005 | Hall et al. | 340/853.4 |
| 2005/0161231 | A1 * | 7/2005 | Prendin et al. | 166/385 |
| 2006/0124353 | A1 * | 6/2006 | Juhasz et al. | 175/40 |
| 2006/0221768 | A1 | 10/2006 | Hall et al. | |
| 2007/0029112 | A1 * | 2/2007 | Li et al. | 175/26 |
| 2007/0030167 | A1 * | 2/2007 | Li et al. | 340/855.1 |
| 2007/0063865 | A1 | 3/2007 | Madhavan et al. | |
| 2007/0188344 | A1 | 8/2007 | Hache et al. | |
| 2007/0257811 | A1 | 11/2007 | Hall et al. | |
| 2008/0024318 | A1 | 1/2008 | Hall et al. | |
| 2009/0146836 | A1 * | 6/2009 | Santoso et al. | 340/854.4 |
| 2009/0151934 | A1 * | 6/2009 | Heidecke et al. | 166/250.01 |
| 2009/0173493 | A1 | 7/2009 | Hutin et al. | |
| 2010/0224409 | A1 * | 9/2010 | Sarhad et al. | 175/40 |
| 2010/0243324 | A1 * | 9/2010 | Veeningen et al. | 175/40 |
| 2012/0080227 | A1 * | 4/2012 | Cardellini et al. | 175/40 |

OTHER PUBLICATIONS

International Application No. PCT/US2010/029378 Search Report and Written Opinion dated Aug. 20, 2010.

* cited by examiner

*Primary Examiner* — Jennifer H Gay
*Assistant Examiner* — Blake Michener
(74) *Attorney, Agent, or Firm* — Conley Rose, P.C.

(57) ABSTRACT

A system and method for communicating with a drill string is provided. The system includes an apparatus having a first coupler, a second coupler, a frame and an actuator. The first coupler may be operatively connectable to the drill string and the second coupler may be operatively connectable to a top drive of a handling system thereby allowing communication between a surface system and a downhole system. The frame may support the first coupler and the second coupler. The frame may be operatively connectable to the handling system. The actuator may be for moving the frame with the first and second couplers between an engaged position operatively connected to the top drive and an uppermost drill pipe, and a disengaged position a distance from the uppermost drill pipe whereby the first and second couplers selectively establish a communication link between the surface system and the downhole system.

28 Claims, 23 Drawing Sheets

SYSTEM AND METHOD FOR COMMUNICATING ABOUT A WELLSITE

CROSS-REFERENCE TO RELATED APPLICATIONS

This application claims the benefit of U.S. Provisional Application No. 61/165,232, filed by Applicant on Mar. 31, 2009, the entire contents of which is hereby incorporated by reference in its entirety. Applicant has also filed another U.S. Non-Provisional Application No. (not yet assigned) entitled SYSTEM AND METHOD FOR COMMUNICATING ABOUT A WELLSITE contemporaneously herewith.

BACKGROUND

The present disclosure relates generally to a system for communicating about a wellsite with, for example, subsurface components. More specifically, the disclosure relates to bi-directional communication systems for use with wellsite equipment, such as surface and/or downhole networks and tools.

Oilfield operations are typically performed to locate and gather valuable downhole fluids. Oil rigs are positioned at wellsites, and downhole tools, such as drilling tools, are deployed into the ground to reach subsurface reservoirs. During such oilfield operations it may be necessary to communicate about the wellsite with, for example, surface, downhole and/or offsite tools and/or equipment. Such communications may be used, for example, to collect downhole data and/or to send commands to control the operation of downhole tools.

Today's wells are often characterized by their increased reservoir contact. This may be achieved by drilling longer step-out wells. The expansion of the extended reach drilling practice alone may push the envelope of the technologies typically deployed. As more complex oilfield operations are employed, communication about wellsites is becoming increasingly important and increasingly complex. Moreover, wellsites have limited bandwidth and limited data rates for transmitting signals about the wellsite. Typical data transmission rates with mud pulse telemetry, for example, may range from about 20 bytes per second (bps) in shallow wellbore sections to about a few bps for a deep well. With the mud pulse signal degrading at extreme depths, engineers are often limited to only a few survey data points for placing their extended reach wellbores. The limited data transmission from downhole tools may not only limit the clarity of the subsurface, but also the mechanical aspects of drilling may remain unknown for adequate decision making.

As drilling operations become more challenging, geologists, operators and engineers need new ways to improve operational efficiency, increase production, reduce NPT and minimize risks. Networked drill pipe is a recent technology transforming current standards for drilling, and has the potential to unlock wells that are un-drillable with current technologies. Such networked or wired drill pipe may be used to provide communication between surface and downhole oilfield operations at the wellsite.

Wired pipe telemetry systems using a combination of electrical and magnetic principles to transmit data between a downhole location and the surface are described in, for example, U.S. Pat. Nos. 6,670,880, 6,641,434 and 7,198,118 (all are hereby entirely incorporated herein by reference). In these systems, inductive transducers are provided at the ends of wired pipes. The inductive transducers at the ends of each wired pipe are electrically connected by an electrical conductor running along the length of the pipe. Data transmission involves transmitting an electrical signal through an electrical conductor in a first wired pipe, converting the electrical signal to a magnetic field upon leaving the first wired pipe using an inductive transducer at an end of the first wired pipe, and converting the magnetic field back into an electrical signal upon entering a second wired pipe using an inductive transducer at an end of the second wired pipe. Multiple wired pipes are typically needed for data transmission between the downhole location and the surface.

Wired drill pipe has the capability to transmit data at a high rate (e.g., 57,000 bits per second). Thus, the wired drill pipe may be used to make downhole information available in real time. The vast increase in data volume at higher quality unlocks the potential for better decisions and further improves drilling performance. The very high data telemetry rates also provide full control over downhole tools, such as rotary steerable tool settings while drilling.

The high-speed, high-volume, high-definition, bi-directional broadband data transmission enables downhole conditions to be measured, evaluated, and monitored, allowing tool actuation and control in real time.

The oil rig has a top drive connected to an upper most of a number of wired drill pipe that form a drill string that extends from the surface to the downhole tool. The top drive may include a rotary connector, or top drive coupler, for linking the wired drill pipe to surface systems, thereby allowing for communication with the downhole tool(s) during drilling. However, many operational problems may occur in extended reach wells while the wired drill pipe is not coupled to the top drive. For example, the top drive is typically not coupled to the wired drill pipe while tripping. Tripping is defined as the set of operations associated with removing or replacing an entire string or a portion thereof from/into the borehole. Getting stuck is a frequent occurrence during tripping. Mud pulse telemetry—with its reliance on fluid flow—doesn't provide downhole measurements while tripping.

During such 'tripping,' the rotary connector is disconnected from the drill string, resulting in a loss of communication between the surface equipment and the drill string. It is typically desirable for the drilling crew to have access to the downhole information while tripping. Tripping may be necessary for a number of well operations involving a change to the configuration of the bottom-hole assembly, such as replacing the bit, adding a mud motor, or adding measurement while drilling (MWD) or logging while drilling (LWD) tools. Tripping can take many hours, depending on the depth to which drilling has progressed. The ability to maintain communication with downhole tools and instruments during tripping can enable a wide variety of MWD and LWD measurements to be performed during time that otherwise would be wasted. This ability may also enhance safety. For instance, in the event that a pocket of high-pressure gas breaks through into the wellbore, the crew may be given critical advance warning of a dangerous "kick," and timely action can be taken to protect the crew and to save the well. Maintaining communication during tripping may also give timely warning of lost circulation or of other potential problems, thereby enabling timely corrective action.

With a broadband network that is always on regardless of flow, drillers may have an insight into the dynamic downhole hydrostatic pressure with real-time measurements while tripping. These measurements may accurately reveal the dynamic surge and swap pressures, instead of relying on conservative rules of thumb or on mathematical models for determining safe operating ranges for the trip speed. Excessive surge pressure could result in time-consuming lost circulation events, while excessive swap pressure could lead to dangerous and costly well control events. With the broadband network integrating the downhole measurements with the surface equipment, a truly closed loop feedback system may be provided. Downhole measurements (e.g., pressure) can set the optimum tripping speed by controlling the speed of the drawworks system.

Connection to the downhole network at surface can be established in various ways. U.S. Pat. No. 7,198,118 describes a screw-in communication adapter that provides for removable attachment to a drilling component when the drilling component is not actively drilling, and for communication with an integrated transmission system in the drilling component. The communication adapter includes a data transmission coupler that facilitates communication between the drill string and the adapter, a mechanical coupler that facilitates removable attachment of the adapter to the drill string, and a data interface.

Despite the advancements in wellsite communications, there remains a need to provide techniques for maintaining communication during oilfield operations. It is desirable that such techniques enable communication during interruptions, such as tripping. It is further desirable that such techniques permit mudflow into the tool such interruptions. Preferably, such techniques provide one or more of the following, among others: reduced communication interruption, increased communication during tripping, reduced manning during tripping, improved and/or repeat downhole measurement (e.g., hydrostatic pressure, drill string strain, inclination, azimuth) while tripping, reduced operational downtime during tripping (and/or prevention of stuck pipe), the acquisition of real time distributed downhole measurements and/or drill string dynamic analysis while tripping, and/or manual and/or automated adjustment of downhole tools while tripping, allow for downhole fluid power generation while tripping, control of swab pressure, and control of bottom hole pressure.

SUMMARY

The disclosure relates to an apparatus for communicating about a wellsite having a surface system and a downhole system. The surface system comprises a rig with a handling system. The handling system has a top drive. The downhole system comprises a downhole tool advanced into the earth on a drill string. The drill string comprises a plurality of wired drill pipe, an uppermost drill pipe of the plurality of wired drill pipe being supported by the handling system. The apparatus comprises a first coupler operatively connectable to the uppermost drill pipe for communication therewith, a second coupler operatively connectable to the top drive and the first coupler for communication therebetween, a frame for supporting the first coupler and the second coupler, the frame operatively connectable to the handling system, and an actuator for moving the frame with the first coupler and the second coupler between an engaged position operatively connecting the first coupler to the uppermost drill pipe of the downhole system and operatively connecting the second coupler to the top drive of the handling system and a disengaged position a distance from the uppermost drill pipe whereby the first coupler and the second coupler selectively establishes a communication link between the surface system and the downhole system.

The present disclosure relates to a system for communicating about a wellsite. The system comprising a surface system and a downhole system at the wellsite. The surface system comprises a rig and a handling system. The handling system has a top drive. The downhole system comprises a downhole tool advanced into the earth on a drill string. The drill string comprises a plurality of wired drill pipe, an uppermost drill pipe of the plurality of wired drill pipe being supported by the handling system, and an apparatus for communicating about the wellsite. The apparatus comprises a first coupler operatively connectable to the uppermost drill pipe for communication therewith, a second coupler operatively connectable to the top drive and the first coupler for communication therebetween, a frame for supporting the first coupler and the second coupler, the frame operatively connectable to the handling system, and an actuator for moving the frame with the first coupler and the second coupler between an engaged position operatively connecting the first coupler to the uppermost drill pipe of the downhole system and operatively connecting the second coupler to the top drive of the handling system and a disengaged position a distance from the uppermost drill pipe whereby the first coupler and the second coupler selectively establishes a communication link between the surface system and the downhole system.

The present disclosure relates to a method for communicating about a wellsite. The wellsite has a surface system and a downhole system. The surface system comprises a rig and a handling system. The handling system having a top drive. The downhole system comprises a downhole tool advanced into the earth on a drill string. The drill string comprises a plurality of wired drill pipe, an uppermost drill pipe of the plurality of wired drill pipe being supported by the handling system. The method comprises supporting the drill string from an elevator of the handling system and disposing an apparatus for communicating about the wellsite on the handling system. The apparatus comprises a first coupler operatively connectable to the uppermost drill pipe for communication therewith, a second coupler operatively connectable to the top drive and the first coupler for communication therebetween, a frame for supporting the first coupler and the second coupler, the frame operatively connectable to the handling system, and an actuator for moving the frame with the first coupler and the second coupler between an engaged position operatively connecting the first coupler to the uppermost drill pipe of the downhole system and operatively connecting the second coupler to the top drive of the handling system and a disengaged position a distance from the uppermost drill pipe whereby the first coupler and the second coupler selectively establishes a communication link between the surface system and the downhole system. The method further comprises actuating the first coupler into communication with the downhole system, actuating the second coupler into communication with the top drive, and communicating with the surface system and the downhole system while supporting the drill string from the elevator.

The present disclosure relates to a method for communication with a drill string in a wellbore. The method comprises supporting the drill string from an elevator of a handling system and disposing an apparatus for communicating with the drill string proximate the handling system. The apparatus comprises a first coupler operatively connectable to the drill string for communication therewith, a second coupler operatively connectable to a top drive of the handling system and the first coupler for communication therebetween, a frame for supporting the first coupler and the second coupler, the frame operatively connectable to the handling system, and an actuator for moving the first coupler to a communicatively engaged position with the drill string. The method further comprises tripping the drill string out of the wellbore, flowing fluid into the drill string through the apparatus while tripping, and communicating with the drill string via the coupler while tripping.

BRIEF DESCRIPTION OF THE DRAWINGS

The present embodiments may be better understood, and numerous objects, features, and advantages made apparent to those skilled in the art by referencing the accompanying drawings. These drawings are used to illustrate only typical embodiments of this disclosure, and are not to be considered limiting of its scope, for the disclosure may admit to other equally effective embodiments. The figures are not necessarily to scale and certain features and certain views of the figures may be shown exaggerated in scale or in schematic in the interest of clarity and conciseness.

FIG. 8A shows the stab connector in a disengaged position. FIG. 8B shows the stab connector in an intermediate position.

FIG. 12A shows the tube connector in a disengaged position.

FIG. 12B shows the tube connector in an engaged position.

DETAILED DESCRIPTION

Figure 1:
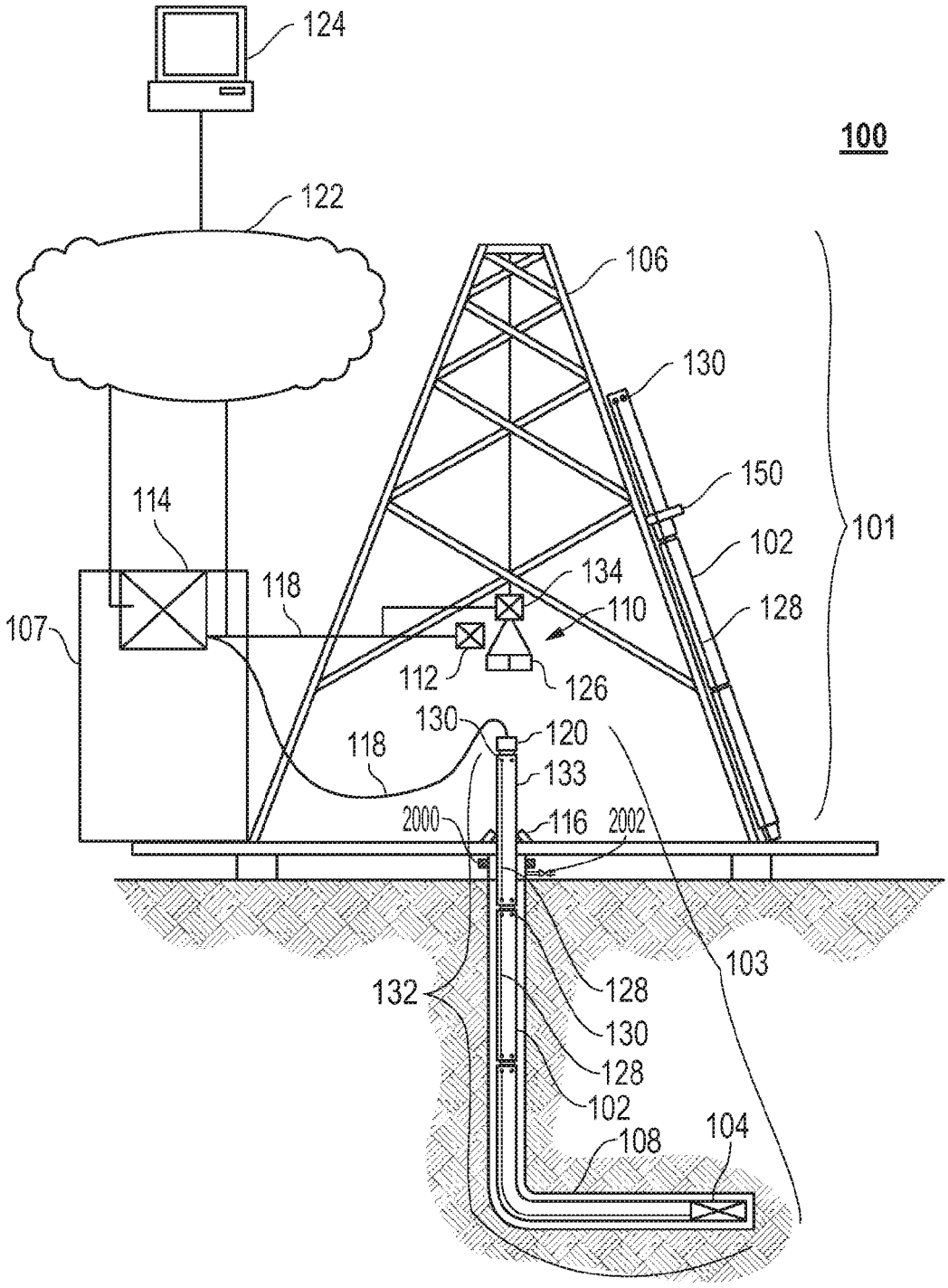
FIG. 1 is a schematic view of a wellsite having a connector for communicating with a surface system and a downhole system.

The description that follows includes exemplary apparatus, methods, techniques, and instruction sequences that embody techniques of the present inventive subject matter. However, it is understood that the described embodiments may be practiced without these specific details. In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. The use of pipe or drill pipe herein is understood to include casing, drill collar, and other oilfield and downhole tubulars. In the following discussion and in the claims, the terms "including" and "comprising" are used in an open-ended fashion, and thus should be interpreted to mean "including, but not limited to . . . ".

FIG. 1 depicts a schematic view of a wellsite 100 including a connector 112 for communicating about the wellsite 100. The connector 112 is preferably configured for communicating with a surface system 101 and a downhole system 103. The downhole system 103 includes a plurality of pipe 102 that forms a drill string 132 and/or one or more downhole tools 104 connected thereto and extended into the earth to form a borehole 108. As shown, the surface system 101 includes a land based derrick or drilling rig 106 and a surface handling system 110. However, it will be appreciated that the wellsite 100 may be land or water based. The surface system 101, as shown, includes the surface handling system 110, a surface unit 107 with a controller 114, one or more slips 116, and one or more cables 118. Additionally, the surface system 101 may also include a communication adapter 120. The surface system 101 may further include a network 122 and one or more computers 124 (in addition to the controller 114). A portion of the surface system 101 may be offsite or remote from the wellsite 100 and/or in communication with offsite systems.

The communication adapter 120, or conventional communication adapter, may allow the controller 114 and/or an operator to communicate with the downhole tool 104 while the drill string 132 is suspended from the slips 116. During drilling, a rotary connector 200 (or a top drive coupler shown as 200 in FIG. 2) establishes communication between the surface system 101, and the downhole system 103. The rotary connector 200 is often disconnected during pauses in the drilling, for example, while tripping the drill string 132 into or out of the wellbore. During such drilling pauses, the drill string 132 may be suspended in the wellbore from the slips 116.

The communication adapter 120 may be screwed into an uppermost pipe 133 of the drill string 132 to provide communication between the surface system 101 and the downhole system 103. The one or more cables 118 may be linked to the communication adapter 120 to provide communication between the drill string 132 and the surface system 101. The communication adapter 120 may be configured so that it does not interfere with the attachment of the elevator 126 to the uppermost pipe 133 of the drill string 132. The communication adapter 120 may be screwed into and removed from the uppermost pipe 133 of the drill string 132 for operation therewith. The communication adapter 120 may optionally be used in conjunction with the connector 112 and the top drive coupler for nearly continuous communication with the downhole system 103 during wellsite operations, such as tripping.

Figure 2:
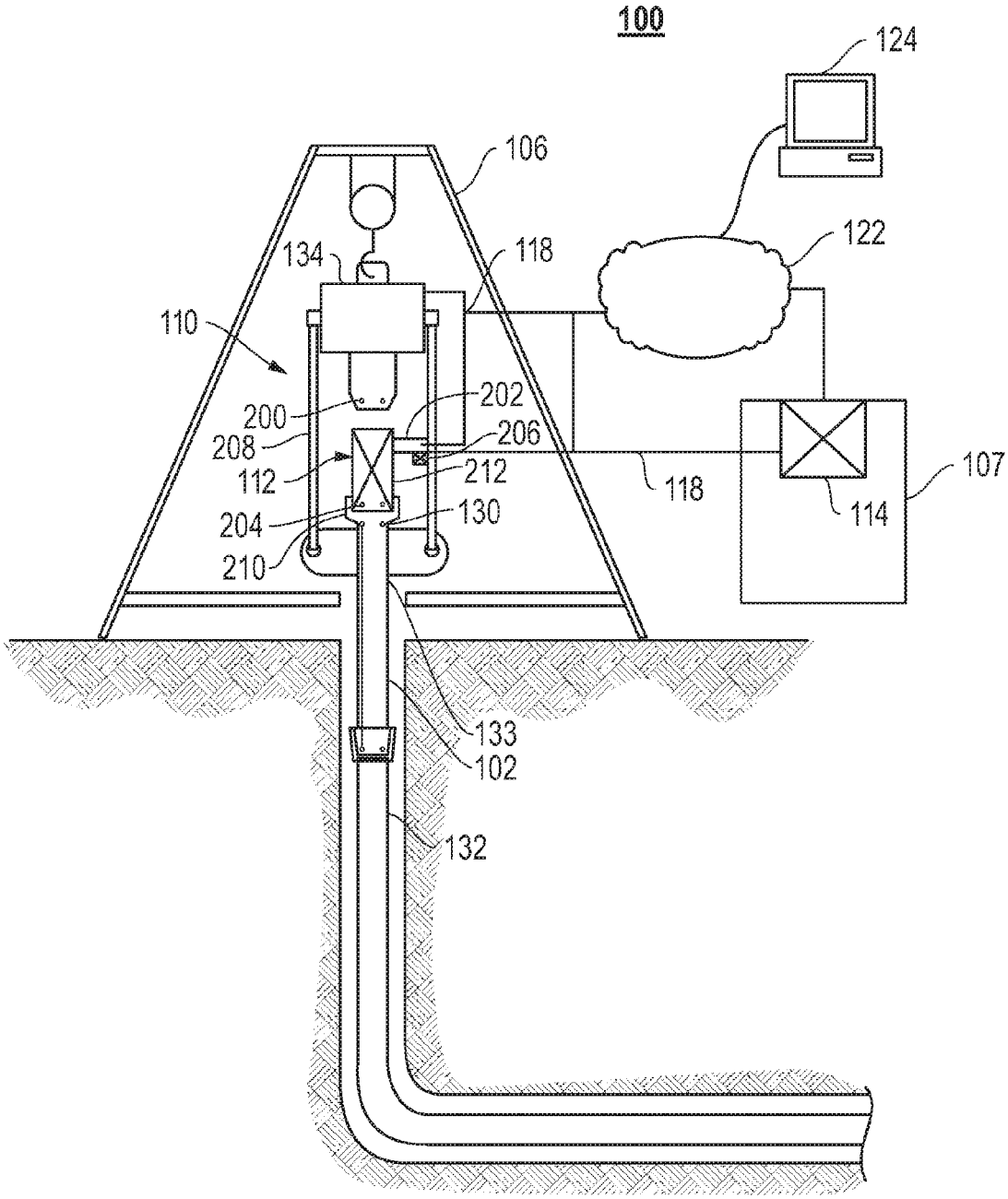
FIG. 2 is another schematic view of a wellsite having a connector for communicating between a surface system and a downhole tool, the connector supported by a surface handling system.

Referring to FIGS. 1 and 2, the connector 112 preferably allows the controller 114 and/or an operator to communicate with the downhole system 103 via the drill string 132 while the uppermost pipe 133 is suspended from an elevator 126 of the handling system 110. The stab assembly, or component, or connector 112 may be adjustable and may be used with elevator links or bales 208 on pipe connections to maintain an electromagnetic link with the drill pipes 102 of the drill string 132 while the drill pipes 102 are suspended from the elevator 126. In some aspects, the stab assembly component, or connector 112, and guide component may be interchangeable for specific connection sizes. The lower arms and parallel arm may be adjustable to establish the distance from the elevator link to the uppermost pipe 133 center. The parallel arm may used to maintain the vertical position of the unit due to possible elevator link tilt. In some aspects, the unit is operated via one or more pneumatic or hydraulic cylinders that act on the upper arm. In some aspects, the unit may be operated via electrically activated servo mechanisms, as will be described in more detail below.

Conventional components and hardware (e.g., any suitable fasteners, hydraulic/pneumatic/electric pistons, springs, gaskets, etc.) may be used to implement aspects of the disclosure. Such components may also be formed of any suitable materials (e.g., plastics, composites, combinations of metal/composite materials, etc.) as known in the art.

The pipe 102, or drill pipe 102, or wired drill pipe 102 (and uppermost pipe 132), as shown is wired drill pipe. Examples of wired drill pipe are described in U.S. Pat. Nos. 6,670,880, 6,641,434 and 7,198,118, previously incorporated herein. The wired drill pipe 102 may include the conductor 128 and the transducer 130. The conductor 128 may be an electric conductor, and may extend substantially along the length of each of the pipe 102 segments. The transducers 130 may be inductive transducers located at the end of each pipe segment. The drill string 132 may be formed of individual wire drill pipes 102 coupled together to form a downhole network of downhole system 103. The wired drill pipe segments may be joined using the derrick 106 to form the drill string 132. Usually two or three wired drill pipes 102 forming a pipe segment of the drill string 132 are added to or removed from the drill string 132 as a single assembly or stand. These may be leaned against the side of the derrick 106 and retained in a fingerboard 150. The drill string 132 may form an integrated transmission system capable of communicating with any number of the downhole tools 104. Although the pipe 102 is described as wired drill pipe having a conductor 128 and a transducer 130, it should be appreciated that the pipe 102 may include any of one or more suitable data transmission systems, or telemetry, such as those described herein.

The surface handling system 110 may be configured for drilling and tripping the pipe 102 and/or drill string 132 into and out of the borehole 108. The surface handling system 110 may include the elevator 126, a top drive 134 (shown schematically), and a draw works (not shown). The top drive 134 may be configured to engage the drill string 132 during drilling operations. The top drive 134 may rotate the drill string 132 to facilitate drilling. The top drive 134 may also allow for fluid flow into the drill string 132. Thus, the top drive 134 may be used in conjunction with a pump (not shown) to pump drilling fluid, and/or cement into the drill string 132. When the top drive 134 is connected to the drill string 132, a top drive coupler (see 200 in FIG. 2) in the top drive 134 may allow for data transmission between the top drive 134 and the drill string 132. When the top drive is disconnected from the drill string 132, the elevator 126 may support the weight of the drill string 132. The elevator 126 may be used to trip the drill string 132 and/or pipe 102 into and out of the borehole 108. The connector 112 may be configured to allow for communication between the surface system 101 and the downhole system 103, when a communication link between the downhole system 103 and the surface system 101 is interrupted, for example when the drill string 132 is supported from the elevator 126 during tripping.

The controller 114 may be configured to control, monitor, analyze and configure various components of the wellsite 100. The controller 114 may be in communication with the surface system 101 via one or more cables 118 and/or communication links. Such surface communication may be between the controller 114 and with various components and systems associated with the surface system 101, such as the elevator 126, the connector 112, the top drive 134, the slips 116, the network 122 and/or the one or more computers 124. The controller 114 may also be in communication with the downhole system 103 (e.g., the drill string 132, and/or the downhole tools 104) via the top drive coupler, the connector 112, and/or the communication adaptor 120. The communication links with the surface system 101, although shown in some cases as cables 118, may be any suitable device or combination of devices for communication including, but not limited to, fiber optics, hydraulic lines, pneumatic lines, acoustic, wireless transmissions and the like.

The network 122 is provided for communicating with components about the wellsite 100 and/or between the one or more offsite communication devices 124, such as one or more computers, personal digital assistants, and/or other networks. The network 122 may communicate using any combination of communication devices or methods, such as telemetry, fiber optics, acoustics, infrared, wired/wireless links, a local area network (LAN), a personal area network (PAN), and/or a wide area network (WAN). Connection may also be made to an external computer (for example, through the Internet using an Internet Service Provider).

The communication adaptor 120 may be configured to engage the drill string 132 and establish communication between the controller 114 and the downhole system 103 (e.g., drill string 132/downhole tools 104) when the drill string 132 is not supported by the elevator 126.

The communication adaptor 120, the connector 112 and the top drive coupler may be assembled to provide communication with the controller 114 and/or the drill string 132 while performing drilling operations and/or tripping.

Figure 3:
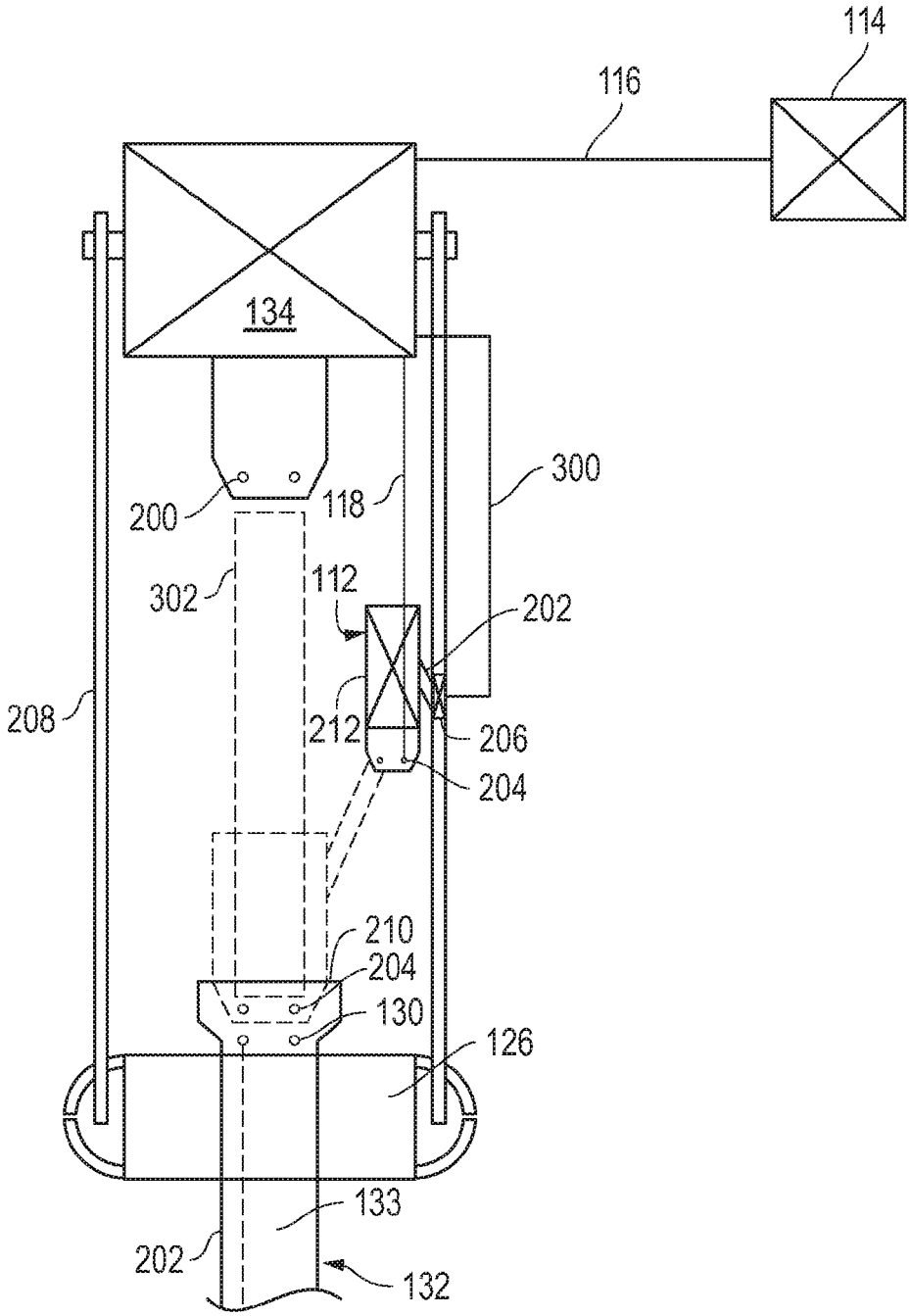
FIG. 3 is a detailed view of the surface handling system of FIG. 2, the connector being a stab connector supported by the surface handling system.

FIG. 2 depicts a schematic of the wellsite 100 having a top drive 134, a connector 112 and an elevator 126. The wellsite 100 of FIG. 2 may be, for example, the same as the wellsite 100 of FIG. 1. As shown, the drill string 132 is supported by the elevator 126. The top drive 134 includes the top drive coupler 200 for communicating with the drill string 132. The connector 112 includes a frame 202 (shown schematically), a connector coupler (or coupler) 204, and an actuator 206. The actuator 206 and the frame 202 may be configured to move the coupler 204 between an engaged position where the coupler 204 is in engagement and communication with the drill string 132 (as shown in FIG. 2), to a disengaged position (as shown in FIG. 3). In the disengaged position of FIG. 3 the connector 112 may be disconnected from the drill string 132, and may allow the top drive 134 to couple to the drill string 132.

The connector 112 may be configured to communicate with the top drive 134 via the top drive coupler 200. As shown schematically in FIG. 3, the connector 112 may include a top drive communication link 302. The top drive communication link 302 may communicatively couple the connector 112 to the top drive 134 while the drill string 132 and/or uppermost pipe 133 is supported by the elevator 126. Thus, the controller 112 may communicate with the drill string 132 through the top drive 134 via the top drive coupler 200, the top drive communication link 302, the coupler 204 and the transducer 130. The top drive communication link 302 may be any device and/or devices for communicatively coupling the connector 112 with the top drive coupler 200. For example, the top drive communication link 302 may include, but is not limited to, a wireless connection between the top drive coupler 200 and the connector 112 and/or transducer 130, a wired connection in communication with the coupler 204 and the top drive 134 via the top drive controls, and/or the top drive coupler 200, and the like. The communication link of the top drive communication link 302 may be made with any communication link described herein, such as cables 118. The communication link between the coupler 204 and the top drive 134 may be made using any combination of electrical and/or mechanical links between the top drive 134 and the coupler 204.

The frame 202 may be any suitable device for moving the coupler 204 between the engaged and disengaged positions. The frame 202 may have one or more arms for moving the coupler 204 as described further herein. As shown in FIG. 2, the frame 202 couples the connector 112 to at least one of the elevator bails 208. However, it should be appreciated that the frame 202 may couple the connector 112 to any suitable location at the wellsite 100, or the handling system 110, so long as the frame 202 may move the coupler 204 between the engaged and disengaged positions. Preferably, such movement may be performed automatically as will be described further herein.

The coupler 204, as shown, is an inductive coupler configured to transmit data across a joint or connection as a magnetic signal. Any suitable inductive coupler for converting an electrical signal to a magnetic field and vice-versa may be used such as described in U.S. Pat. No. 6,670,880, previously incorporated. In the '880 patent, the inductive coupler includes a magnetically-conductive electrically insulating element (MCEI) having a U-shaped trough in which is located an electrically conducting coil. A varying current applied to the electrically conducting coil generates a varying magnetic field in the MCEI. The coupler 204 may be configured to enter a box end 210 of the uppermost pipe 133 of the drill string 132 and located proximate the transducer 130 of the uppermost pipe 133, or drill string coupler. Having the coupler 204 and the transducer 130 (or two couplers) proximate one another (as shown in FIG. 2 with the coupler 204 communicating across the pipe joint) creates a "transformer." In this example, the transformer is an RF signal transformer. However, in other aspects of the disclosure, the coupler 204 may use other methods for transmitting data across the connector 112, or stab, pipe connection. For example, the coupler 204 may be an acoustic coupler, a fiber optic coupler, or an electrical coupler for communicating or transmitting a signal (i.e., an acoustic, optical, or electrical signal) across the connection. Examples of coupler configurations that may be used to implement aspects of the disclosure are further described in U.S. Pat. No. 6,670,880 previously incorporated herein.

The actuator 206 may be any suitable device for moving the coupler 204 between the engaged position and the disengaged position. For example, the actuator may be a hydraulic piston and cylinder, a pneumatic piston and cylinder, a servo, and the like.

The connector 112 may include a body 212, or stab. The body 212 may be configured to support the coupler 204 and connect the coupler 204 to the frame 202. As shown in FIGS. 2 and 3, the body 212 is configured to at least partially move into a box end 210 of the drill string 132. The body 212 may have any suitable shape, so long as it is configured to support the coupler 204 and allow the coupler 204 to move to the engaged position.

The controller 114 may communicatively couple directly to the actuator 206 and/or the coupler 204 via a direct cable 118 or communication link, as shown in FIG. 2. Further, the actuator 206 and/or the coupler 204 may be configured to communicate with the controller 114 via the top drive 134, as shown in FIGS. 2 and 3. For example, as shown in FIG. 3, the actuator 206 may be controlled via a hydraulic control line 300 from the top drive 134 to the actuator 206, and the coupler 204 may be coupled to the top drive 134 via a cable 118, or communication link. Using the top drive 134 to operate as the communication link between the connector 112 and the controller 114 enables the operator to use the top drive to control the connector 112. Although, the actuator 206 is described as being controlled by the hydraulic line 300, it should be appreciated that any suitable control line may be used including, but not limited to, a pneumatic line, an electric line, and the like.

Figure 4:
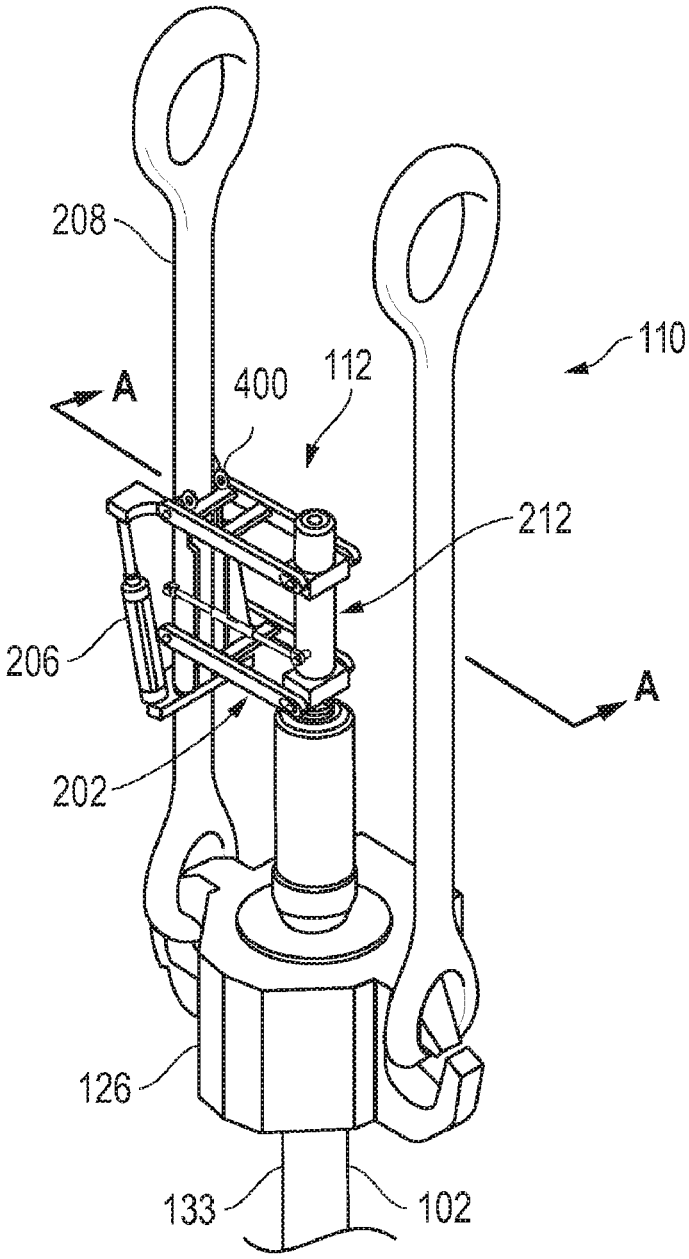
FIG. 4 is a schematic view of a portion of the surface handling system and stab connector of FIG. 3.
Figure 5A:
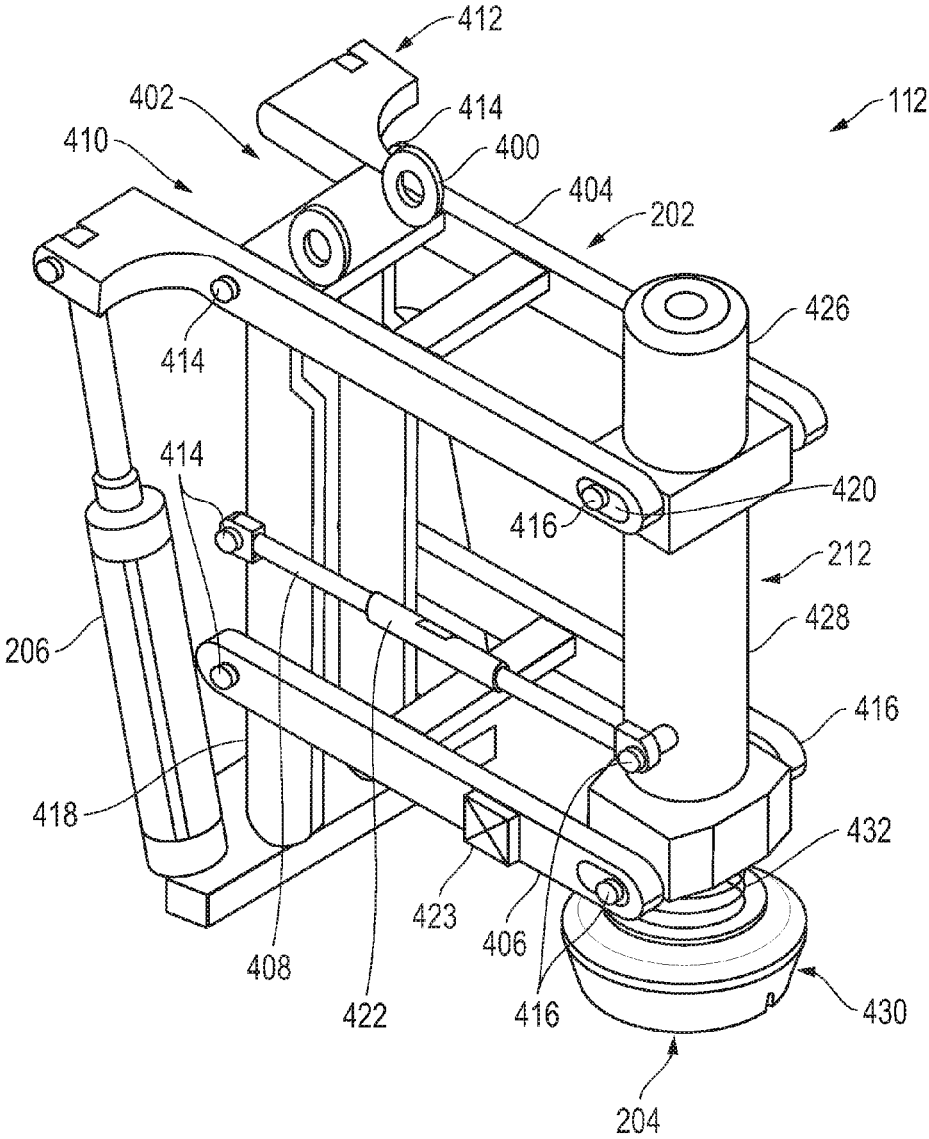
FIG. 5A is a schematic view showing the stab connector of FIG. 3 in greater detail.

FIG. 4 is a schematic view of a portion of the surface handling system 110 and the connector 112 of FIG. 3. This view shows the connector 112 as a stab unit or assembly mounted on elevator links or bails 208. The connector 112 as shown includes the frame 202, the actuator 206, the body 212 (or stab), and one or more lift eyes 400. The lift eyes 400 may be configured to lift the connector 112 during transport and/or to mechanically operate the connecter 112 without using the actuator 206. The connector 112 is shown in greater detail in FIGS. 5A and 5B. The frame 202 as shown in FIG. 5A includes an elevator bail connector 402, an actuator arm 404, a guide arm 406 and an alignment arm 408. The elevator bail connector 402 may be any suitable device for coupling the connector 112 to the elevator bails. As shown, the elevator bail connector 402 includes at least one gap 410. The gap 410 may be configured to fit the elevator bail substantially within the gap 410. With the elevator bail within the gap 410, the elevator bail may be secured to the connector 112 using any number of methods including clamping, bolting, welding, screwing, and the like. Although the elevator bail connector 402 is shown as the at least one gap 410, it should be appreciated that any method of securing the connector 112 to the elevator bails may be used.

The actuator arm 404, shown as an upper arm, may be configured to move the body 212 and/or the coupler 204 between the engaged position of FIG. 2 and the disengaged position of FIG. 3 in response to the movement of the actuator 206. The actuator arm 404 as shown comprises two arms parallel to one another; however, it should be appreciated that one or more arms may be used. The two actuator arm 404 may include an actuator end 412, an arm connector 414, and a body end 416.

The actuator end 412 of the actuator arm 404 may be configured to engage the actuator 206. As shown in FIGS. 4 and 5A, the actuator includes a hydraulic piston and cylinder coupled to each of the two actuator arms 404. However, it should be appreciated that one or more of the pistons/cylinders may be used. Further, although described as a hydraulic piston and cylinder actuator, it should be appreciated that any actuator 206 may be used, such as those described herein. The actuator 206 may be connected to the actuator end 412 using a pin connection, as shown, or any other suitable connector device. As the actuator 206 is moved, the actuator end 412 of the actuator arm 404 is moved in response thereto, thereby moving the body 212, as will be described in more detail herein.

The arm connector 414, as shown in FIG. 4, is a fixed pivot point that the actuator arm 404 may pivot about as the actuator 206 moves the connector 112 between the engaged and disengaged position. The pivot point may be at a fixed location on the frame 202. For example, as shown, the pivot point is located on a support member 418 which couples to, or is integral with, the elevator bail connector 402. Thus, the pivot point may be substantially fixed relative to the elevator bails 208 (shown, e.g., in FIGS. 2 and 3). The arm connector 414 may be coupled to the pivot point using a pin connector as shown, although it should be appreciated that any method of connecting the actuator arm 404 to the pivot point may be used including, but not limited to, a bolt connection and the like.

The body end 416 of the actuator arm 404 couples the actuator arm 404 to the body 212 of the connector 112. As shown, each one of the two arms of the actuator arm 404 couples to opposing sides of the body 212. The body end 416 may couple to the body 212 in a manner that allows the actuator arm 404 to move the body 212 and/or coupler 204 (shown in FIG. 2) between the engaged and disengaged positions. As shown, the body end 416 couples the actuator arm 404 to the body 212 with a pin connection similar to the arm connector 414 connection, although it should be appreciated that any suitable method of coupling the actuator arm 404 to the body 212 may be used. As the actuator 206 moves the actuator end 412 of the actuator arm 404 about the pivot point of the arm connector 414, the body end 416 moves the body 212 and/or the coupler 204, as shown in FIG. 2 between the engaged and disengaged positions as will be discussed in more detail below.

The actuator arm 404 may have an adjustable connection 420 between the body 212 and the actuator arm 404. As shown, the adjustable connection 420 may comprises a slot on the actuator arm 404 configured to allow the pin coupled to the body 212 to translate within the slot as the body 212 is moved. The adjustable connection 420 may allow the body 212 to remain in a substantially vertical, or in-line with the drill string 132 (as shown in FIGS. 1, 2, 3 and 4), position as the actuator arm 404 moves the body 212. Although the adjustable connection 420 is described as a slot in the actuator arm 404, it should be appreciated that any suitable method of making the connection adjustable may be used, such as allowing a pin fixed in the actuator arm 404 to translate along a slot on the body 212.

The guide arm 406, or lower arm as shown on FIG. 5A, may be configured to guide the body 212 and/or coupler 204 (shown in FIG. 2) between the engaged and disengaged position. The guide arm 406 may include two arms in a similar manner to the actuator arm 404. The guide arm 406 may be provided with the arm connector 414 and the body end 416. In a similar manner to the actuator arm 404, the arm connector 414 allows the guide arm 406 to pivot about a pivot point on the support member 418 of the frame 202. The body end 416 of the guide arm 406 couples the guide arm 406 to the body 212, and allows the guide arm 406 to guide the body 212 as the actuator arm 404 moves the body 212. The connections of the guide arm 406 to the body 212 by the arm connector 414 and the body end 416 may be similar to the connections described above for the actuator arm 404. The guide arm 406 may include simple pin connections on each end thereby substantially fixing the distance between the arm connector 414 and the body end 416. Thus, as the actuator arm 404 moves the body 212, the guide arm 406 allows the body 212 to move at the fixed distance of the guide arm 406.

The guide arm 406 may be sized to a fixed length designed for a specific elevator and/or pipe size. The size of elevators 126 and pipe 102 (shown in FIGS. 1 and 2) vary in size. The connector 112 may be configured to guide the coupler 204 into the box end of the pipe 102. Thus, the length of the guide arm 406 may vary depending on the size of the pipe 102 and/or the elevator 126. The length of the guide arm 406 may be varied in any suitable manner. For example, the guide arm 406 may adjust using a threaded clevis 423, shown in FIG. 5A. The threaded clevis 423 may allow adjustment to the length of the guide arm 406 based on the size of the elevator 126 and/or pipe 102 used at the derrick 106 (shown in FIG. 1). The length may be adjusted prior to installing the connector 112 on the surface handling system 110, or with the connector 112 on the surface handling system 110. Although described as the guide arm 406 having an adjustable length, the length may vary by having several different sized guide arms 406 that may be replaced when different sized pipes and elevators are used.

The alignment arm 408, shown as a parallel arm to the guide arm 406, may be configured to align the body 212 and/or the coupler 204 with the box end 210 and/or the transducer 130 of the drill string 132 (shown in FIG. 2). As shown, there is one alignment arm 408, although it should be appreciated that there may be any number of alignment arms. Similar to the guide arm 406, the alignment arm 408 may have an arm connector 414 and a body end 416. The arm connector 414 and the body end 416 may couple to the support member 418 and the body 212 in a similar manner as the guide arm 406. The alignment arm 408 may be configured to have a substantially fixed length in a similar manner as the guide arm 406. The alignment arm 408 may include a threaded collar 422 configured to adjust the length of the alignment arm 408.

The alignment arm 408, in combination with the guide arm 406, may be configured to position the body 212 and/or the coupler 204 substantially in alignment with the drill string 132 and/or the transducer 204 when the connector 112 is in the engaged position (shown in FIG. 2). As shown, the alignment arm 408 is substantially parallel with the guide arm 406 as the body 212 pivots between the engaged and disengaged position. Having the arms substantially parallel, may allow the body 212 to travel in a substantially vertical direction, or in line with a longitudinal axis of the drill string, as the actuator arm 204 pivots the body 212 between the disengaged and engaged positions. Although, the alignment arm 408 and the guide arm 406 are described as being parallel and moving the body 212 in a substantially vertical position as it rotates between the engaged and disengaged positions, it should be appreciated that the alignment arm 408 and the guide arm 406 may have different lengths and may not be parallel, so long as the coupler 204 is positioned in communicative engagement with the transducer 130, when the connector 112 is in the engaged position.

Although the guide arm 406 and the alignment arm 408 are described as being adjustable in length using the threaded clevis 423 and the threaded collar 422 respectively, it should be appreciated that any number of devices may be used to adjust the length of the guide arm and the alignment arm. For example, there could be several of the guide arms and alignment arms of varying lengths that may be substituted depending on the size of the elevator and the pipe, or telescoping arms using a separate actuator for adjusting the length may be used. It should also be appreciated that while the length of the guide arm 406 and the alignment arm 408 are described as being manually adjustable, there may be an arm length actuator configured to adjust the length of the arms. The arm length actuator may be configured to operate in a similar manner as the actuator 206.

Figure 5B:
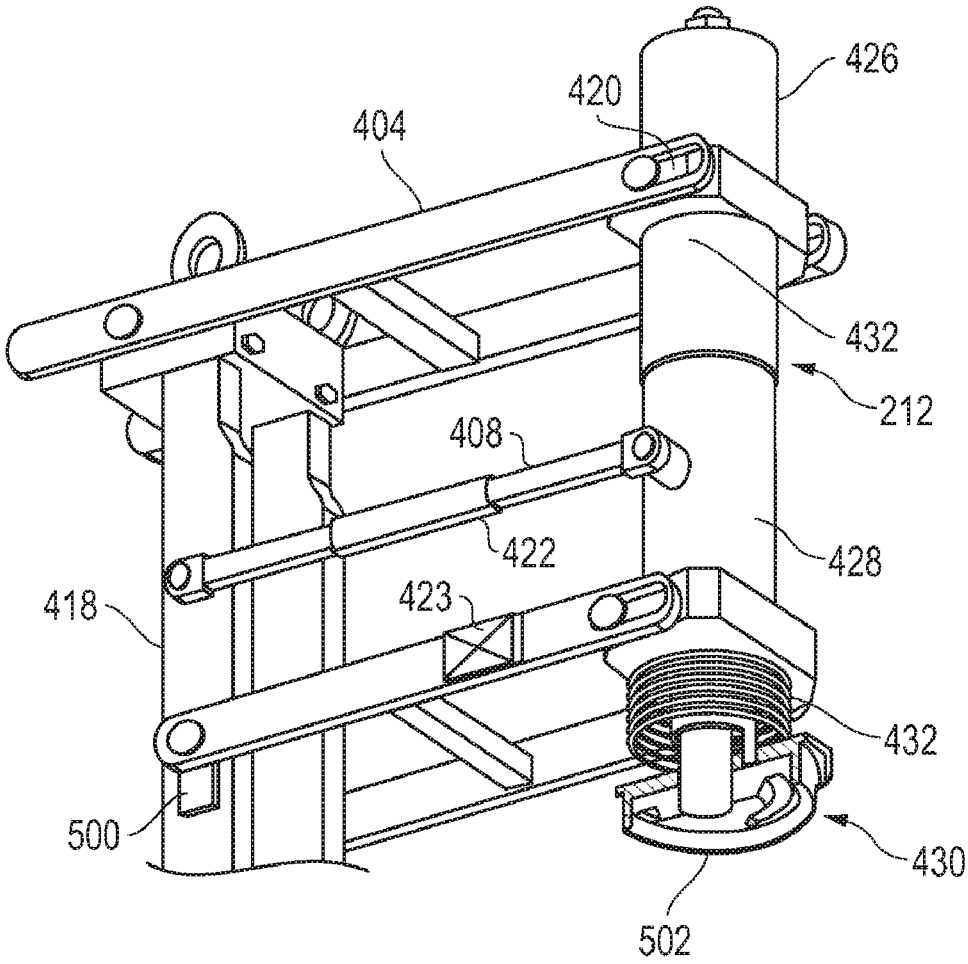
FIG. 5B is a detailed view of a portion of the stab connector of FIG. 5A.

The connector 112 may include a stop 500, or mechanical stop, configured to limit the movement of the guide arm 406 and/or the alignment arm 408, as shown in FIG. 5B. The stop 500 may be configured to stop the body 212 at a position where it is substantially in line with the drill string 132 (as shown in FIG. 1). The stop 500 as shown is simply a node, or boss, on the support member 418 configured to stop the rotation of the guide arm 406. Although the stop 500 is described as being located on the support frame 418 and engaging the guide arm 406, it should be appreciated that the stop 500 may be located at any suitable location for engaging and stopping the travel or the guide arm 406 and/or the alignment arm 408. Further, the stop 500 may be configured to be the top of the box end of the pipe (see, e.g., 210 of FIG. 3).

Although the actuator arm 204 is shown located above the guide arm 406 with the alignment arm 408 located therebetween, it should be appreciated that the arms may be located in any suitable arrangement so long as the arms move the connector 112 between the disengaged and engaged position.

Figure 6A:
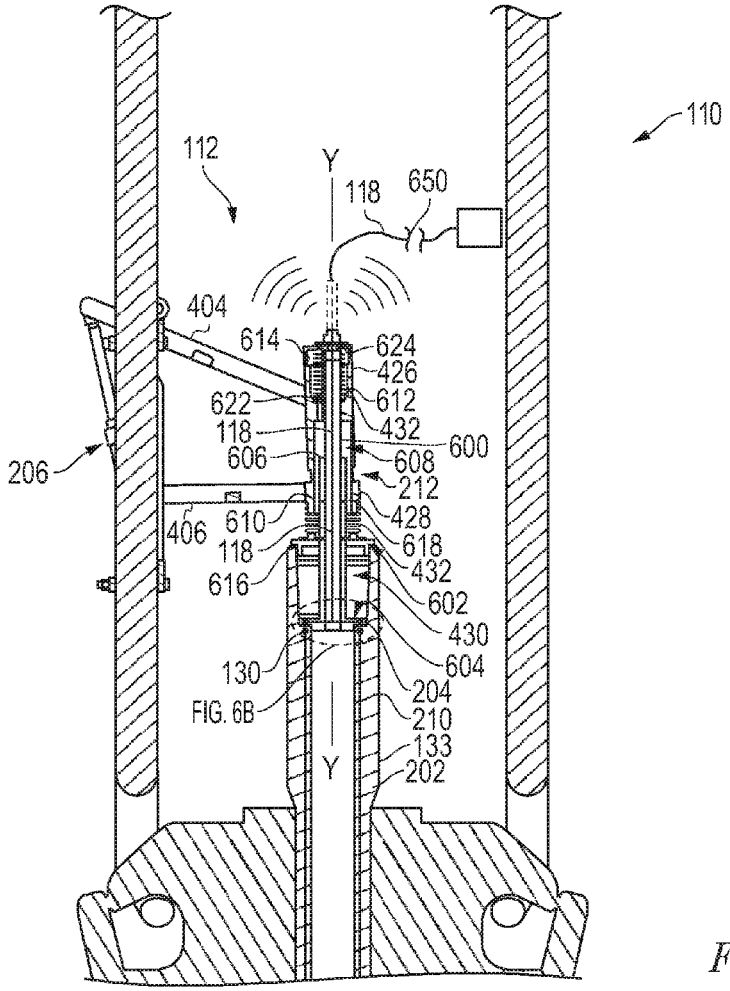
FIG. 6A is a schematic cross-sectional view of the surface handling system and stab connector of FIG. 4 taken along line A-A, the stab connector having a stab positioned in a wired drill pipe of the downhole system.

The body 212 may include an actuator body portion 426, a guide body portion 428, a guide 430 (as shown in FIGS. 5A and 5B), and one or more biasing members 432. FIG. 6A shows a cross-sectional view of the connector 112 of FIG. 4 taken along line A-A. The body 212, as shown in FIG. 6A, may further include a coil stab 600, an outer guide stab 602, a coupler stab 604, and the coupler 204.

The actuator portion 426 of the body 212, as shown in FIGS. 5-6A is an outer housing coupled to the actuator arm 404. The actuator portion 426 may be configured to move with the actuator arm 404 as the actuator arm 404 moves. Further, the actuator portion 426 may be configured to move the guide body portion 428 and the coil stab 600 as the actuator arm 404 moves. The coil stab 600 may couple to the actuator portion 426. As shown, the coil stab 600 couples to the top of the actuator portion 426. The coil stab 600 may be coupled to the actuator portion 426 using any method such as bolting, welding, screwing, and the like. The connection between the coil stab 600 and the actuator portion 426 may be a rigid connection or a connection that allows the coil stab 600 freedom to move, or adjust in a radial direction relative to the centerline of the body 212. Because the coil stab 600 is operatively connected to the actuator portion 426, the coil stab 600 moves with the actuator portion 426. Although the body 212 is shown having the coil stab 600 that is moved by the actuator portion 426, it should be appreciated that the coil stab 600 may couple directly to the actuator arm 404, thereby alleviating the need for the actuator portion 426.

The coil stab 600, as shown in FIG. 6A, is a substantially tubular shaped member. The coil stab 600 may be operatively coupled to the actuator portion 426 and the coupler stab 604. The tubular shape of the coil stab 600 may allow for a cable 118, or communication link to run through the center of the coil stab 600. The coil stab 600 is configured to move the coupler stab 604, and thereby the coupler 204 into communication with the transducer 130. Although the coil stab 600 is shown as a tubular member, it should be appreciated that the coil stab 600 may be any shape that allows the actuator 206 to move the coupler 204 into engagement with the transducer including, but not limited to, a cylindrical, a square prism, a rod, and/or other shape.

The actuator portion 426 of the body may be configured to move relative to the guide body portion 428 of the body 212. As shown in FIG. 6A, the guide body portion 428 couples to the guide arm 406 and the alignment arm 408 (as shown in FIG. 5A). The guide body portion 428 may have a central bore 606, an alignment portion 608, and a base portion 610. The central bore 606 may be configured to allow the coil stab 600 to move relative to the guide body portion 428 along the Y-Y axis that is substantially in line with the body 212. The central bore 606 may be configured to have a larger inner diameter than the outer diameter of the coil stab 600. The larger diameter may allow the coil stab 600 the freedom to move and adjust in a radial direction relative to the Y Y axis as the coil stab 600 is positioned into the engaged position. Further, the central bore 606 may be configured to engage the outer diameter of the coil stab 600 thereby guiding the coil stab 600.

The alignment portion 608 of the guide body portion 428 may be configured to allow the actuator portion 426 to move relative to the guide body portion 428 along the longitudinal Y-Y axis. As shown in FIG. 6A, the alignment portion 608 has an outer surface 612 configured guide an inner surface 614 of the actuator portion 426. As shown, the outer surface 612 and the inner surface 614 are substantially cylindrical in shape, thereby operating in a similar manner to a piston and cylinder. However, it should be appreciated that the alignment portion 608 and the actuator portion 426 may have any shape so long as the alignment portion 608 is configured to guide the actuator portion 426 as the actuator portion 426 moves relative to the guide body portion 428.

The base portion 610 may be configured to couple the guide body portion 428 to the guide 430. As shown in FIGS. 5A and 6A, the base portion 610 is operatively coupled to the guide arm 406 and the alignment arm 408. The guide arm 406 and alignment arm 408 may maintain the position of the base portion 610 as the connector 112 moves into the engaged position as will be described in more detail below.

The guide 430 may include the outer guide stab 602, and the coupler stab 604, or coupler equipped stab. The outer guide stab 602 may be configured to align and/or protect the coupler stab 604 as the connector 112 moves into the engaged position. The outer guide stab 602 may be configured to allow for axial and radial alignment of the coupler stab 604 as the body 212 moves into the engaged position. As shown in FIG. 6A, the outer guide stab 602 has a pipe guide 616, a coil stab guide 618, and the biasing member 432. The pipe guide 616 may be configured to engage the box end 210 of the uppermost pipe 133 and protect the coupler stab 604 from damage during operation. The pipe guide 616, as shown, has a substantially conical outer surface configured to engage the box end 210 of the uppermost pipe 133. As the body 212 engages the box end 210 of the uppermost pipe 133, the conical outer surface of the pipe guide 616 may be the first portion of the connector 112 to engage the uppermost pipe 133. The conical outer surface allows the pipe guide 616 to self align the guide 430 and thereby the coil stab 600 as the body 212 engages the uppermost pipe 133. Further, the pipe guide 616 may protect the coupler stab 604 by substantially surrounding, or enclosing, the coupler stab 604 when the coupler stab 604 is in the retracted pre-engagement position. To this end, the coupler stab 604 may substantially fit within the pipe guide 616 when in the retracted position.

The coil stab guide 618 may be configured to align the guide 430 linearly with the coil stab 600. As shown the coil stab guide 618 is a tubular guide portion having an inner diameter configured to guide and/or engage an outer diameter of the coil stab 600. Thus, as the pipe guide 616 engages the box end 210 of the uppermost pipe 133, the conical shape of the pipe guide 616 aligns the coupler stab 602 with the axis of the uppermost pipe 133. The coil stab guide 618 which is coupled to the pipe guide may align the coil stab 600 with the linear axis of the uppermost pipe 133.

The outer stab guide 602 may be operatively coupled to the base portion 610 via the biasing member 432. This allows the outer stab guide 602 to have an axial and/or radial freedom of movement while engaging the box end 210 of the uppermost pipe 133. As shown, the biasing member 432 is a coiled spring; however, it should be appreciated that the biasing member may be any member suitable for allowing the outer stab guide 602 to flexibly align with the box end 210 of the uppermost pipe 133.

Figure 6B:
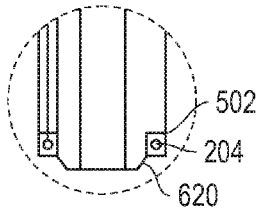
FIG. 6B is a detailed view of a lower end of the stab of FIG. 6A.

The coupler stab 604 may be operatively coupled to the coil stab 600. Thus as the actuator 205 moves the coil stab 600, the coupler stab 602 moves. The coupler stab 602 may include the coupler 204. The coupler stab 602 is configured to locate the coupler 204 into a position that allows the coupler 204 to communicate with the transducer 130. The coupler stab 602 may be any suitable shape, as shown in FIGS. 5A and 6A, the coupler stab 602 is circular or semicircular in shape. The coupler stab 602 may include a groove 502 (see FIGS. 5B and 6B) at the pipe face of the coupler stab 602. The coupler 204 may be disposed in the groove 502. The coupler stab 604 may further include a coupler stab guide 620, as shown in FIG. 6B. The coupler stab guide 620 may be configured to engage an inner diameter of the box end 210 of the uppermost pipe 133. Thus, the coupler stab guide 620 may further align the coupler stab 602 and thereby the coupler 204 with the transducer 204 as the coil stab 600 moves linearly toward the transducer 204. As shown, the coupler stab guide 620 has a conical shape; however, it should be appreciated that any suitable shape may be used.

As shown in FIG. 6A, the stab assembly, or connector 112 may be configured with a cable, such as cable 118, that extends from the coil embedded in the coupler 204 and runs through the coil stab 600 to the upper end of the stab. The cable 118 may couple directly to any of the cables and/or communication links described herein. The electrical cable, or the cable 118, may run through the stab assembly, or connector 112, between the inductive coupler, coupler 204 and the upper end of the stab guide, or body 212. At the upper end of the body 212, the cable 118 may exit through a conduit and can be linked to establish communication between the surface system 101, and/or the controller 114, and the downhole system 103 formed by the coupled pipes 102 in the drill string 132 as shown in FIGS. 1 and 2. The cable 118 may be linked to a transducer, or connector transducer 650, configured for remote wireless communication. Further, it should be appreciated that the connector 112 may send data to the controller and/or surface equipment via wireless communication.

In addition to the biasing member 432 located between the base portion 610 and the outer guide stab 602, there may be a biasing member 432 configured to bias the coil stab 600 toward the retracted position. As shown in FIG. 6A, the biasing member 432 may engage a shoulder 622 of the guide body portion 428 and a top 624 of the actuator body portion 426. Thus the biasing member 432 provides a force on the actuator body portion 426 toward the retracted position. The actuator 206 may overcome this force to communicatively engage the coupler 204 with the transducer 130.

Figure 7:
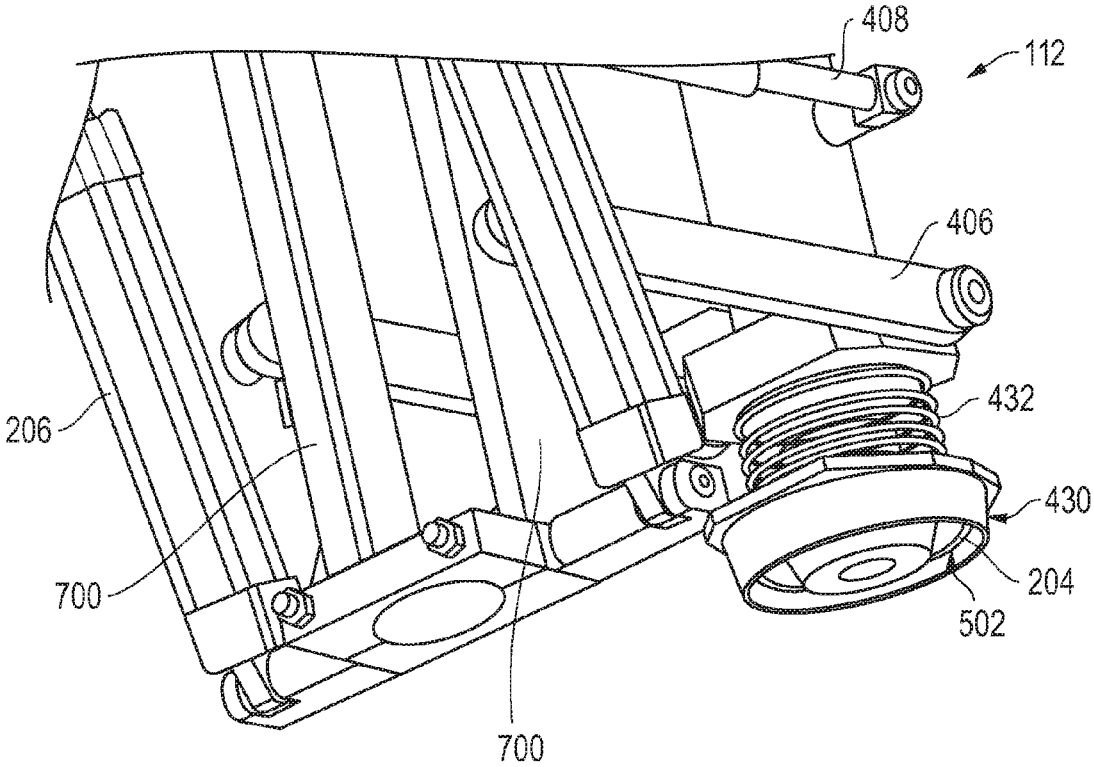
FIG. 7 is a schematic view of a portion of the stab connector of FIG. 5A.

FIG. 7 shows the stab assembly, or connector 112, having the groove 502, or annular groove, provided at the bottom face of the guide 430. Inside the groove 502 may be disposed an inductive coupler (or coupler) 204. The connector 112 may include one or more alignment marks 700 as also shown in FIG. 7. The one or more alignment marks 700 may be used to facilitate mounting of the device on the rig equipment, or surface handling system 110 (as shown in FIG. 2) for more accurate placement and reliability. Thus, the alignment marks 700 may be used to establish proper mounting height of the connector 112 on the elevator bail, or link (see, e.g., 208 of FIGS. 2-3). The alignment mark 700 may be aligned with the top of the uppermost pipe 133 in the elevator 126 (see e.g., FIG. 2).

Figure 8A:
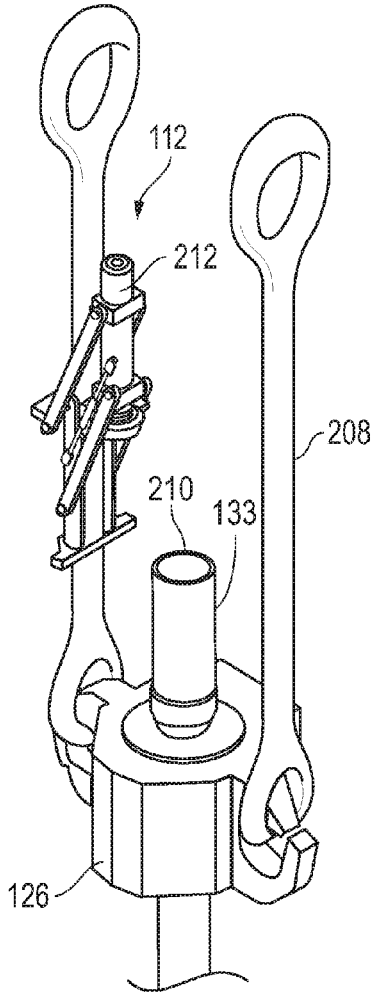
FIGS. 8A-8B are schematic views of the surface handling system and stab connector of FIG. 5A.
Figure 8B:
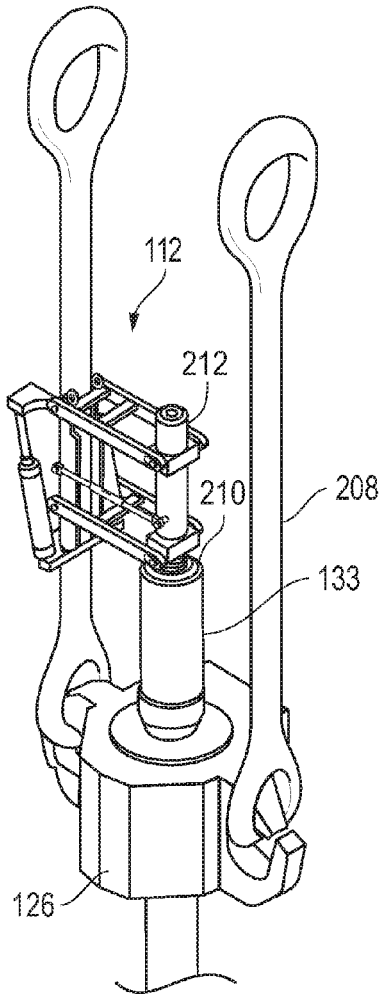
Figure 9A:
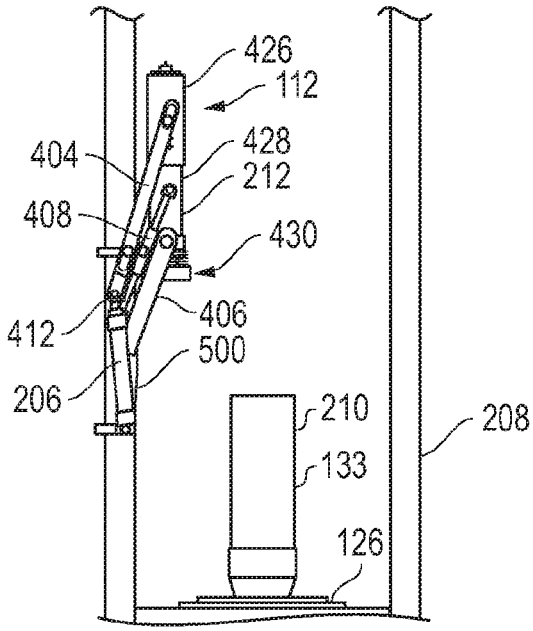
FIGS. 9A-9G are schematic views depicting the stab connector of FIG. 3 as it moves from a disengaged position adjacent an elevator bail of the surface handling system, to an engaged position adjacent a wired drill pipe.
Figure 9B:
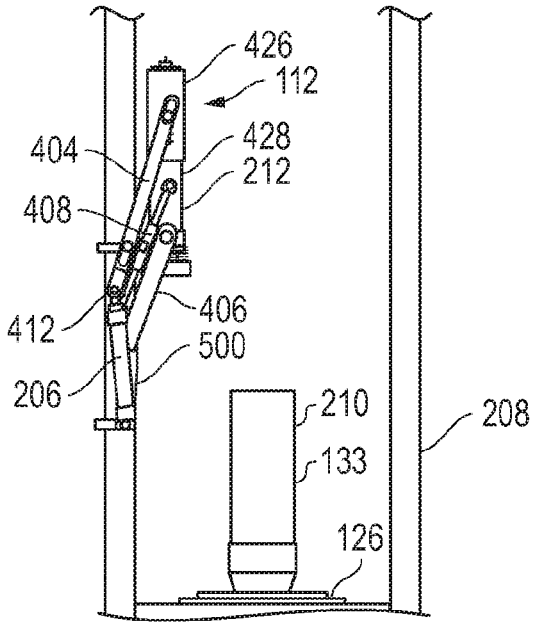
Figure 9C:
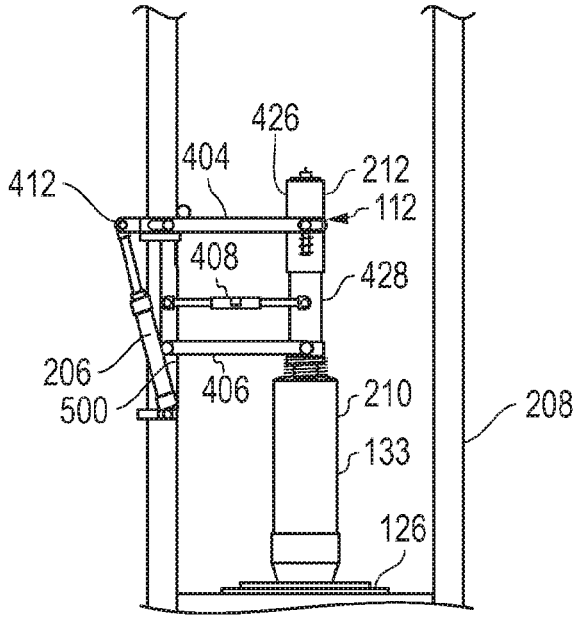
Figure 9D:
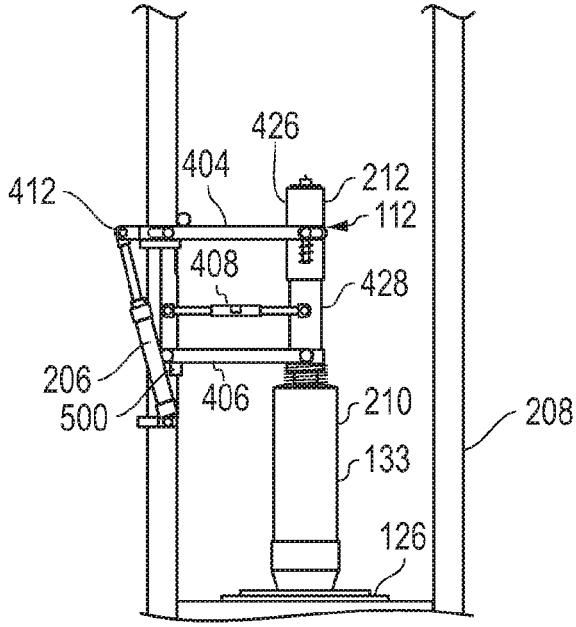

FIGS. 8A-8B provide various views of the connector 112 moving between a disengaged and an engaged position. FIGS. 8A-8B show schematic views of the connector 112 coupled to the elevator bails 208 and moving from the disengaged position, shown in FIG. 8A, to an intermediate position, as shown in FIG. 8B. As shown, the uppermost pipe 133 is supported in the elevator 126. In the disengaged position, the connector 112 is secured safely out of the way of the box end 210 of the uppermost pipe 133. In this position, the top drive 134 (as shown in FIG. 2) may engage the box end 210 without damaging the connector 112. FIG. 8B shows the intermediate position. In the intermediate position, the body 212 has engaged the box end 210 of the uppermost pipe 133. However, the coil stab 600 and, therefore, the coupler 204 are in the retracted position and not communicatively engaged with the uppermost pipe 133. FIGS. 9A-9G show side views of the connector 112 moving from the disengaged position to the engaged position. In FIGS. 9A and 9B, the connector 112 is in the disengaged position. In the disengaged position the connector 112, or stab assembly, is retracted in its stowed condition against the elevator links 208. In this position, the actuator 206 may be fully retracted and the arms, the actuator arm 404, the guide arm 406 and the alignment arm 408, may be substantially parallel to one another. The connector 112, or unit, may be then activated via cylinders, or the actuator 206, until the lower arms reach the mechanical stop 500, as shown in FIG. 9C. At this point, if the unit mounting height is setup properly, the guide 430 will be flush with the pipe shoulder and centered in the pipe connection of the uppermost pipe 133. The operator, or controller 114 as shown in FIG. 1, may actuate the actuator 206 in order to move the connector 112 toward the engaged position. The actuator 206 may extend the piston of the actuator 206, thereby moving the actuator end 412 of the actuator arm 404. As the actuator end 412 moves toward the engaged position, or up as shown in FIGS. 9C and 9D, the actuator arm 404 moves the body 212 of the connector 112 toward the box end 210 of the uppermost pipe 133. The actuator arm 404 moves the actuator body portion 426 of the body 212. The actuator body portion 426 may be effectively coupled to the guide body portion 428 of the body 212. Moving the actuator body portion 426 of the body 212 may move the guide body portion 428. The guide body portion 426 is coupled to the guide arm 406 and the alignment arm 408 in order to guide the body 212 into alignment with the box end 210 of the uppermost pipe 133.

As shown in FIGS. 9C and 9D, the actuator has moved the body 212 into axial alignment with the uppermost pipe 133. At this stage, the mechanical stop 500, for example engaging the guide arm 406 may stop further movement of the guide arm 406, the alignment arm 408 and/or the guide body portion 428 of the connector 112. The guide 430 may have aligned the coupler and/or coupler stab with the pipe transducer as will be described in more detail below. With the guide body portion 428 of the body 212 fixed, continued movement of the actuator arm 404 may overcome the biasing force in the body 212 and move the actuator body portion 426 and the coupler toward the engaged position.

Figure 9E:
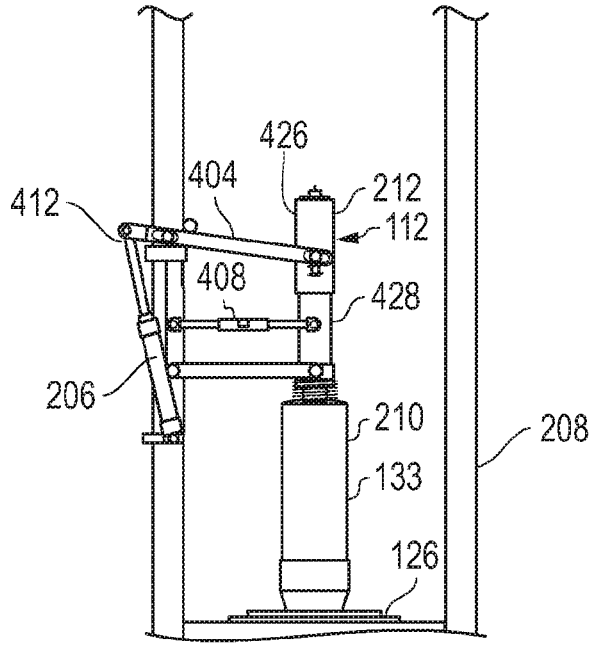
Figure 9F:
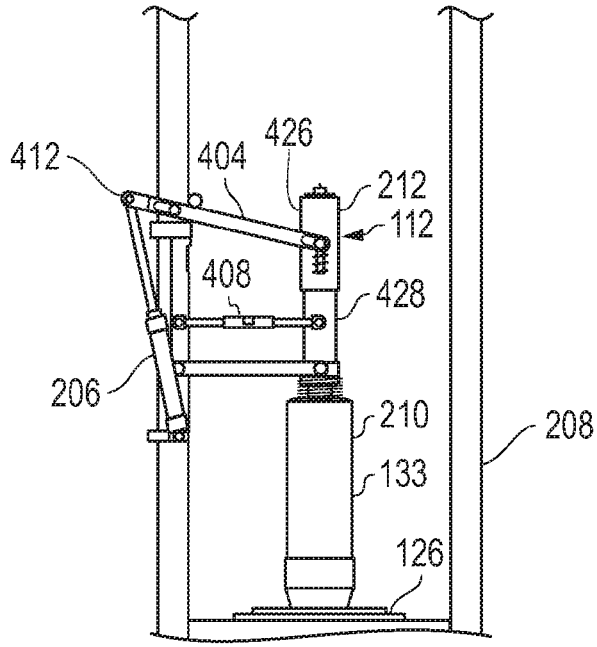
Figure 9G:
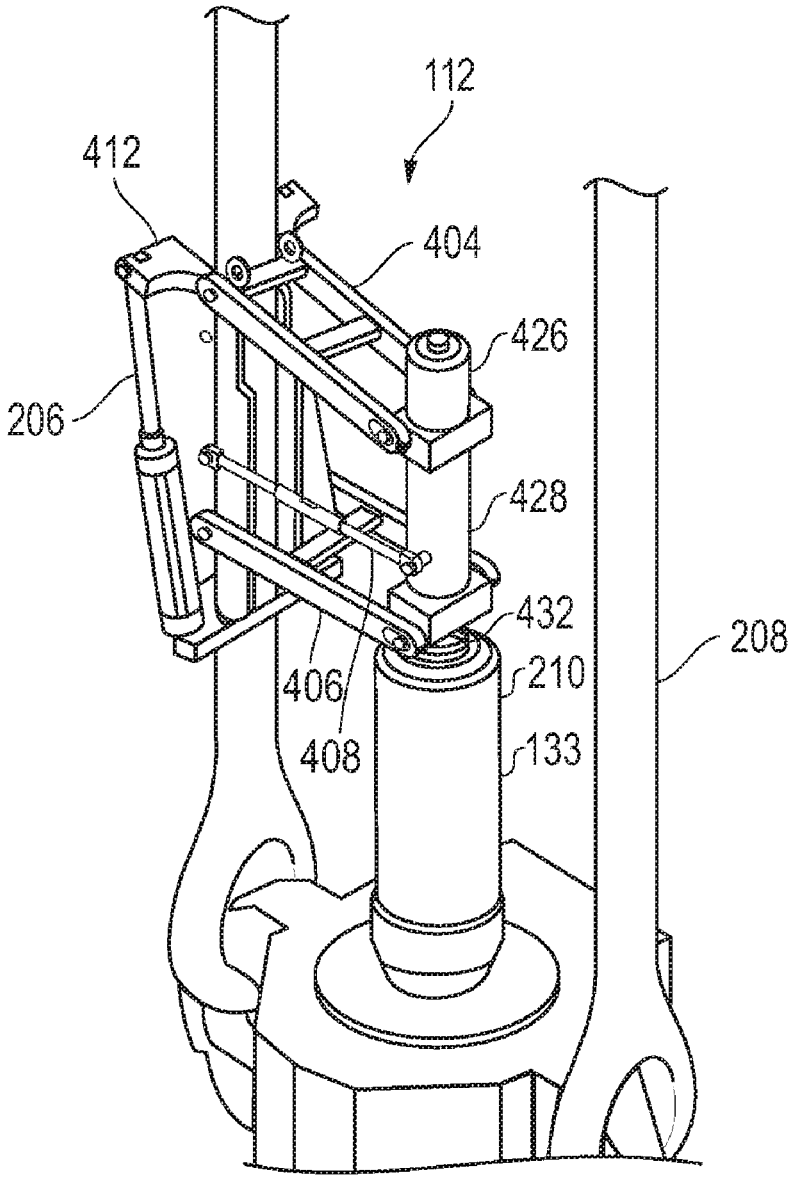

As shown in FIG. 9E, the actuator arm 404 is no longer parallel with the guide arm 406 and the alignment arm 408. This is due to the actuator body portion 426 and thereby the coupler, moving linearly relative to the guide body portion 428. Continued movement of the actuator arm 404 moves the connector 112 and therefore the coupler into the engaged position as shown in FIG. 9F. FIG. 9G shows another view of the connector 112 in the engaged position. As shown in FIGS. 9F and 9G, the actuator 206 has moved the coupler 204 into the engaged position. In the engaged position, the body 212 of the connector 112, engages the box end 210 of the uppermost pipe 133 and establishes a communication link with the uppermost pipe 133 and any downhole tools 104, shown in FIG. 1, coupled to the uppermost pipe 133.

Figure 10A:
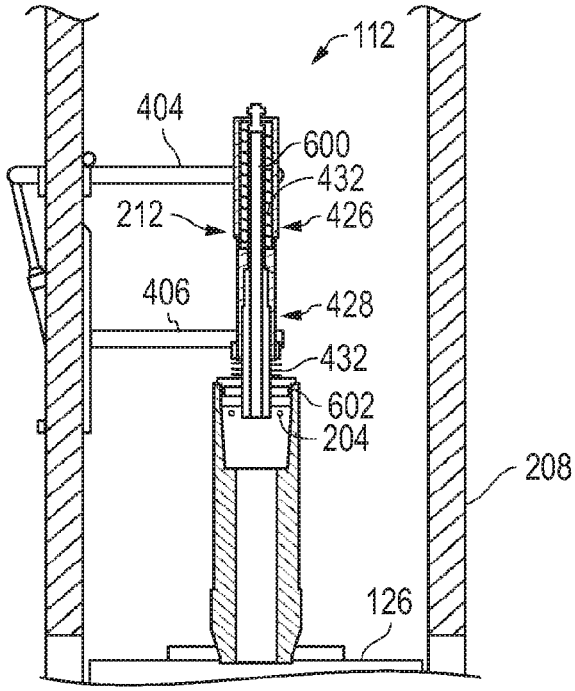
FIGS. 10A-10E are schematic cross-sectional views of the surface handling system and stab connector of FIG. 4 taken along line A-A as it moves from a disengaged position adjacent an elevator bail of the surface handling system, to an engaged position adjacent a wired drill pipe.
Figure 10B:
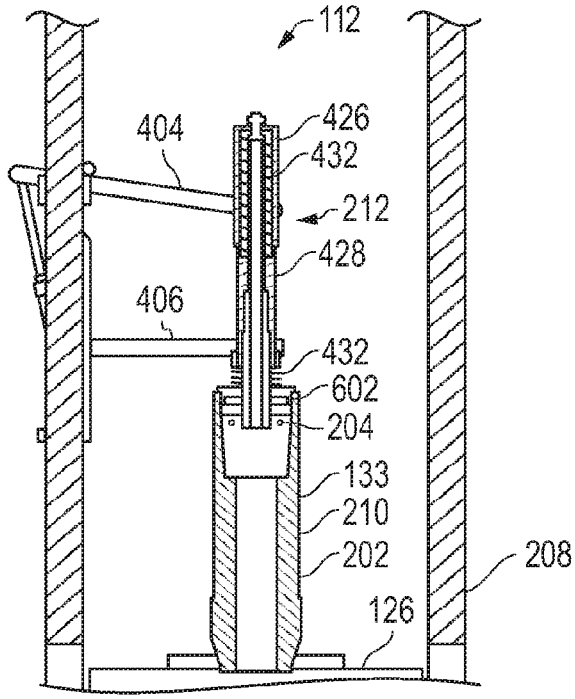
Figure 10C:
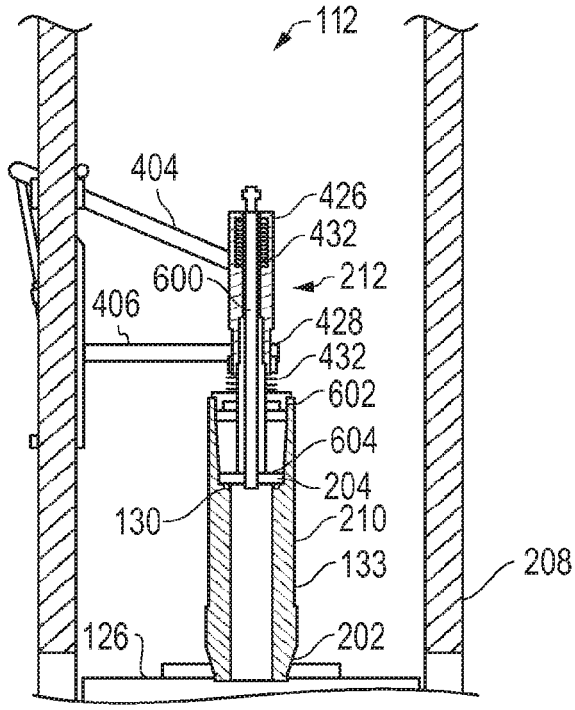

FIGS. 10A-10E show side views, partially in cross-section, of the connector 112 moving from the intermediate position into the engaged position. In the intermediate position, as shown in FIG. 10A, the guide arm 406 has engaged the mechanical stop 500 (FIG. 5B). The outer guide stab 602 has entered the top of the box end 210 of the uppermost pipe 133. The outer guide stab 602 may have engaged the top of the box end 210 upon entry and radially adjusted the position of the coupler 204, and/or coil stab 600. The coil stab 600 is still in the retracted position and thereby the outer guide stab 602 may still be surrounding the coupler stab 602. Continued actuation of the actuator 206 may overcome the biasing force caused by biasing member 432. Upon overcoming the biasing force, the actuator body portion 426 and thereby the coil stab 600 move linearly relative to the guide body portion 428, as shown in FIG. 10B.

As the cylinders, or actuators 206, continue to extend, the upper arm, or actuator arm 404, continues to rotate the lower arm, the guide arm 406, and the parallel arm, the alignment arm 408, are stopped as shown in FIG. 10B. This extends the electrical stab, coil stab 600, into the pipe connection. The cylinders, or actuators 206, may continue to extend until the coupler-equipped stab links electromagnetically with the coupler, or transducer 130, on the pipe end, or box end 210, completing the transmission circuit of the wired pipe. In FIG. 10B, the coupler stab 604 has moved into the box end 210 due to continued movement of the actuator body portion 426 and thereby the coil stab 600. Continued actuation of the actuator arm 404 moves the actuator body portion 426, the coil stab 600 and thereby the coupler stab 604, until the coupler stab 604 engages pipe proximate the transducer 130. The biasing members 432, along with the internal diameter of the body 212 that allows the coil stab 600 to move, may allow the coil stab 600 and thereby the coupler 204 to self align into communicative engagement with the transducer 130, as show in FIGS. 10C-10E. Once the coupler 204 is in communicative engagement with the transducer 130 the controller 114 (as shown in FIG. 1) may communicate with the drill string 132 and/or the downhole tools 104. This communication may be substantially maintained during tripping of the drill string 132 and/or downhole tools 104 into and out of the borehole, as shown in FIG. 1.

Figure 10D:
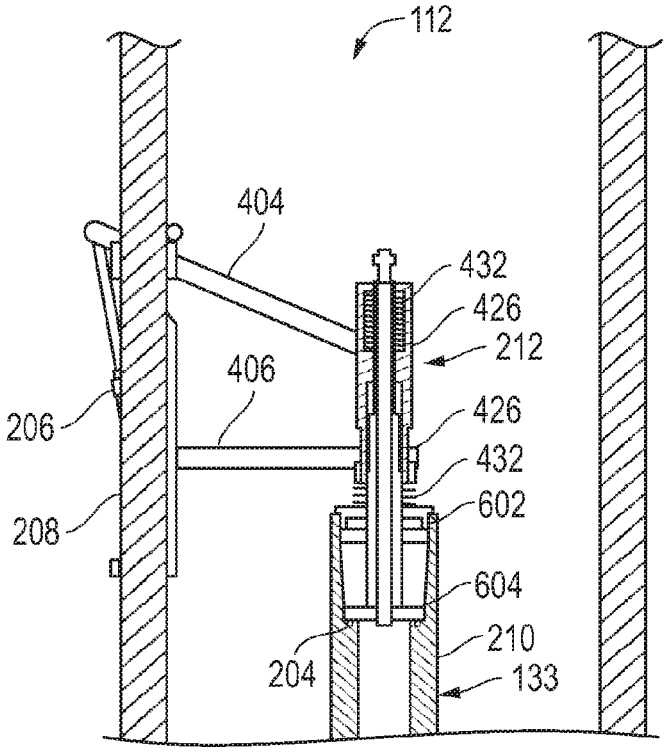
Figure 10E:
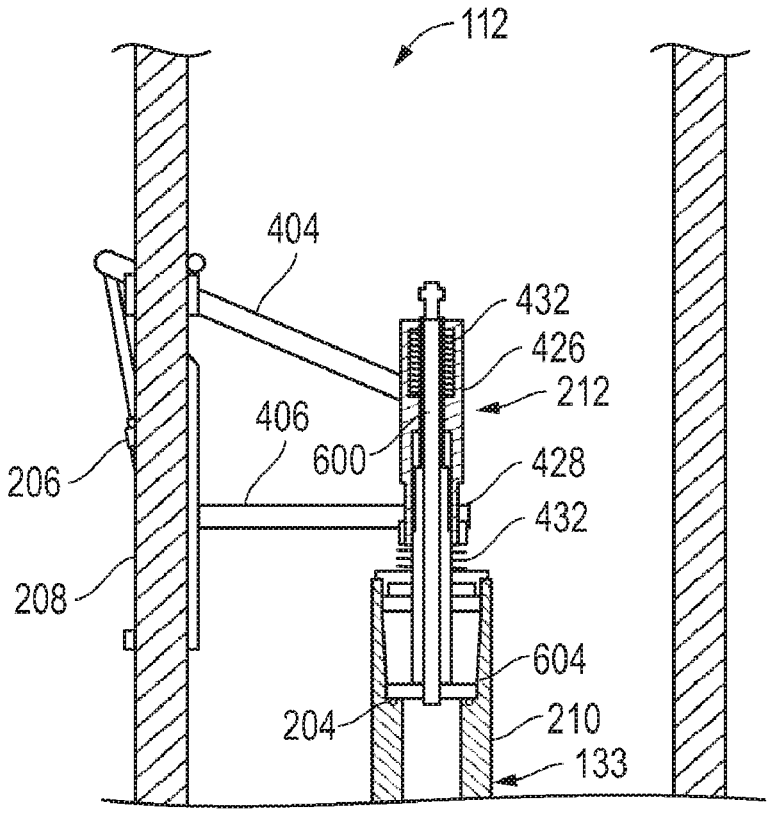

As shown in FIG. 10D, the guide stab, or outer guide stab 602, centers the device, or connector 112, on the pipe end, or box end 210 of the uppermost pipe 133. The connector 112 may be set with very loose tolerances compared with the rest of the outer housing to account for any movement or misalignment with the tool/pipe joint, or connector 112/box end 210. The inner coil stab, or the coupler stab 604, has the coupler 204 in it and is driven down by the upper arm, or the actuator arm 404, once the guide stab is in place. The inner coil stab, or coupler stab 604, may slide with relatively tight tolerances to the outer guide stab 602. This is to ensure the coupler 204 is positioned correctly and is not damaged during installation. As shown in FIG. 10E, the coil stab 600 is shown misaligned. The biasing members 432, or springs, may allow for the connection of the coupler 204 with the transducer 130 with the misalignment. The assembly, the connector 112, is equipped with springs, or biasing members 432. An outer spring, or the lower biasing member 432, allows for axial misalignment of the guide stab, or coil stab 600, when mated to the tool/pipe joint, connector 112/uppermost pipe 133, and the outer housing. A second (inner) spring, the upper biasing member 432 as shown, keeps the inner coil stab, coupler stab 604 retracted into the outer guide stab 602 to ensure the guide stab, or the coil stab 600, is securely centered on the tool/pipe, connector 112/uppermost pipe 133, before the coil stab 600 is extended into place to keep from damaging the coupler 204.

An aspect of the disclosure provides a method for communicating about a wellsite. Such communication may be with the surface system 101 and/or the downhole system 103. The method includes positioning the coupler 204 configured for signal communication at the borehole surface, linking the coupler 204 with an end of the tubular configured with a second coupler, or transducer, and establishing a communication link across the couplers.

Figure 11:
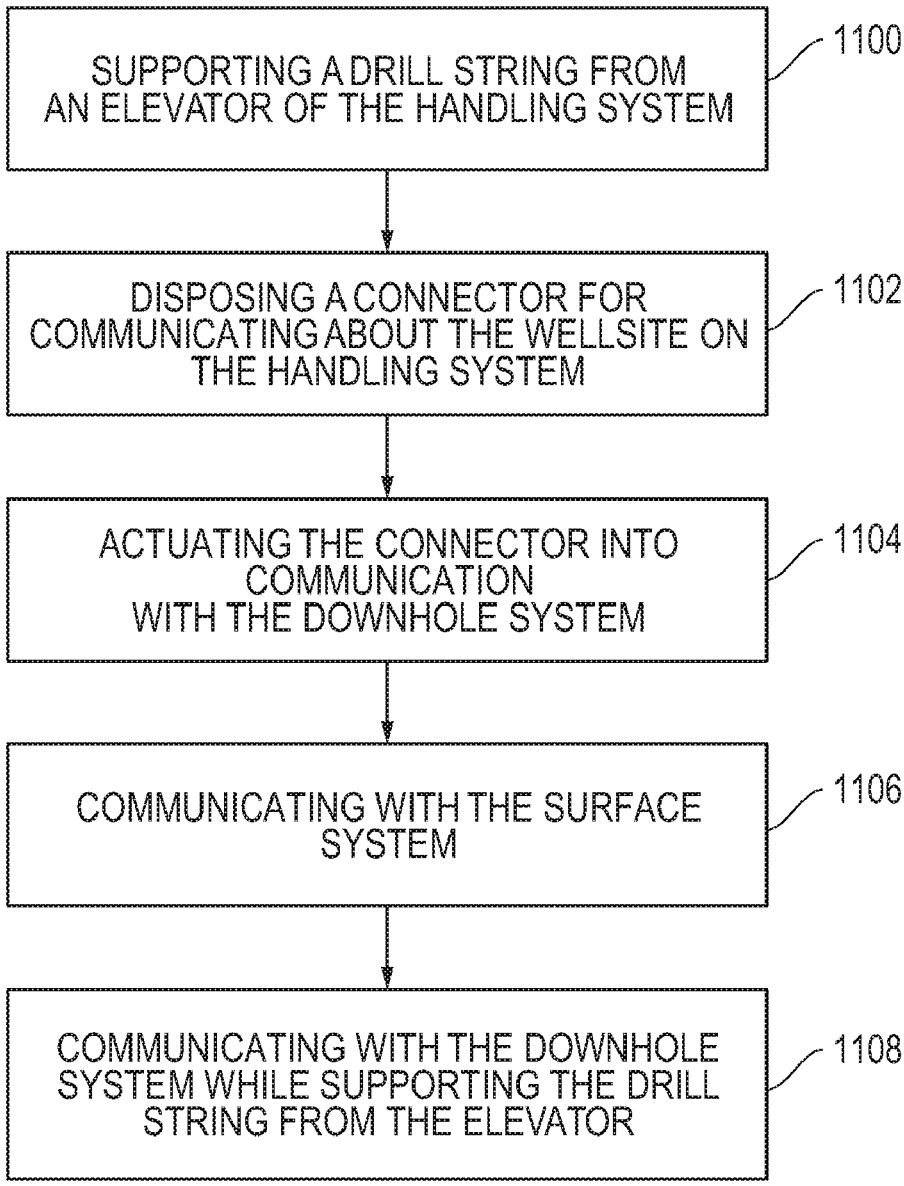
FIG. 11 is a flow chart illustrating a method for communication about a wellsite.

FIG. 11 is a flowchart depicting a method of communicating about a wellsite. The method includes supporting 1100 a drill string from an elevator of a handling system. Disposing 1102 a connector for communicating with the drill string on the handling system. The method further includes actuating 1104 the connector into communication with the downhole system. The method further includes communicating 1106 with the surface system. The method further includes communicating 1108 with the downhole system while supporting the drill string from the elevator. The method may optionally include determining a downhole pressure while tripping the drill string into and out of the wellbore. The method may further include measuring tension and/or compression in the drill string during wellbore operations, for example using a strain gauge. Thus, dynamic hydrostatic pressure, and also the drill string strain (tension and compression)—in real time while dynamically moving the drill string in the vertical direction for example while tripping.

Figure 12A:
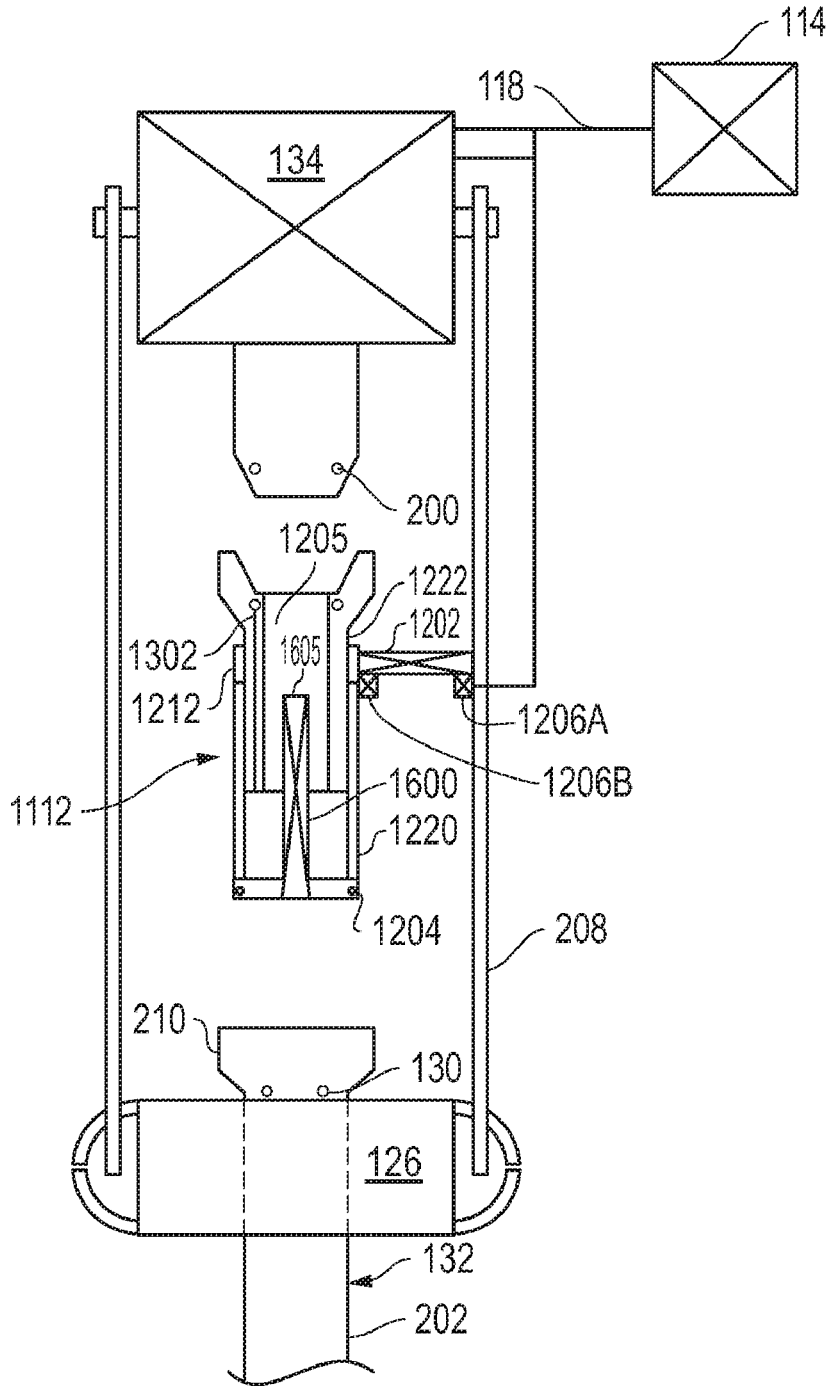
FIGS. 12A-12B are schematic views of the surface handling system of FIG. 2, the connector being a tube connector supported by the surface handling system.
Figure 12B:
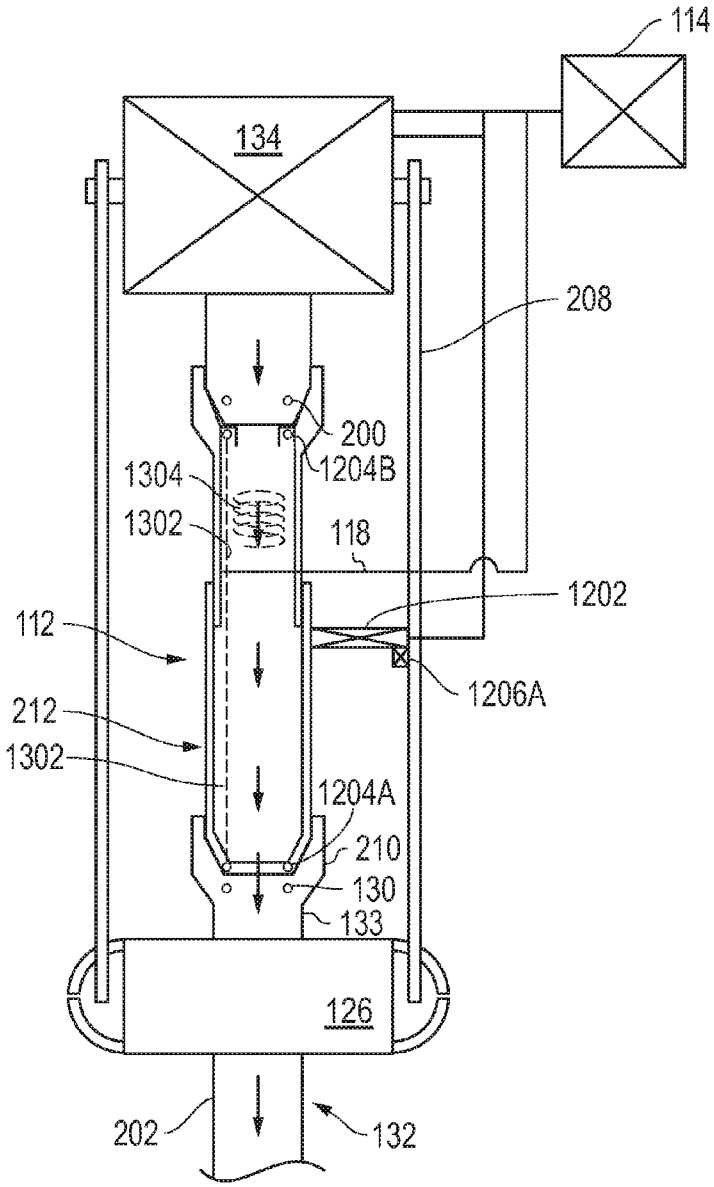

FIGS. 12A-12B show schematic views of a tube connector or connector 1112 which may be used, for example, as the connector 112 of FIGS. 1 and 2 for communicatively coupling the top drive coupler 200, and/or the controller 114 with the transducer 130. The tube connector 1112 may be configured for use with the top drive 134 and elevator 126 in place of the stab connector 112 of FIGS. 3 and 4. In addition to the transfer of data via the tube connector 1112, the tube connector 1112 may be configured to be in fluid communication with the top drive 134 for the passage of fluid, such as mud, therethrough. As shown, the tube connector 1112 includes a frame 1202, a coupler 1204, the actuator 1206(A, B), the body 1212, and the top drive communication link 1302.

The frame 1202 may be any device suitable for moving the tube connector 1112 from the disengaged position into the engaged position. Thus, the frame 1202 may include all or parts of any of the frames described above. In one aspect, the frame 1202 may be one or more arms which attach the tube connector 1112 to at least one of the elevator bails 208. The one or more arms may operate is a manner similar to the arms of the frame described above. Thus, in the disengaged position the tube connector 1112 may be located at a position wherein the top drive 134 may connect directly with the box end 210 of the drill string 132. In the engaged position the frame 1202 may locate the body 1212 of the tube connector 1112 in communication with the transducer 130 and/or the top drive coupler 200.

The actuator 1206A may be any suitable device for moving the tube connector 1112 from the disengaged position to the engaged position. Thus, the actuator 1206A may be similar to the actuators 206 described above. The actuator 1206A may be configured to move the body 1212 into linear alignment with the drill string 132 and/or the top drive 134. Further, the actuator 1206A may move one or more portions of the body 1212 into communicative engagement with the transducer 130 and/or the top drive coupler 200 as will be described in more detail herein. In addition to the actuator 1206A, there may be any number of additional actuators 1206B for moving portions of the connector 1112 fully into the engaged position. For example, the actuator 1206B may be a hydraulic actuator configured to extend the body 1212, or portions of the body 1212 into engagement with the top drive coupler 200 and/or the transducer 130, as will be described in more detail below. The actuator 1206A and the additional actuators 1206B may be powered in a similar manner to the actuator 206 described above.

The body 1212 may include a pipe portion 1220 and a top drive portion 1222. The pipe portion 1220 may be configured to engage and/or communicatively engage the box end 210 of the uppermost pipe 133 and/or the transducer 130. The top drive portion 1222 may be configured to engage and/or communicatively engage the top drive 134 and/or the top drive coupler 200, as shown schematically in FIG. 12B. As shown in FIGS. 12A and 12B, the pipe portion 1220 may be configured to move in a telescoping manner relative to the top drive portion 1222. Thus, the body 1212 may be moved into linear alignment with the top drive 134 and/or the drill string 132 in a retracted position. Once in linear alignment, the actuator 1206A, and/or 1206B may extend one or more portions of the body 1212 in order to move the connector 1112 into the engaged position.

The pipe portion 1220 and/or the top drive portion 1222 may include a coupler 1204A and 1204B respectively. The couplers 1204A and 1204B may be similar to any of the couplers and/or transducers described herein. As shown in FIGS. 12A and 12B, the couplers 1204A and 1204B are within the pipe portion 1220 and the top drive portion 1222, respectively. However, it should be appreciated that the couplers 1204A and 1204B may have any suitable arrangement for communicatively engaging and disengaging the transducer 130 and/or the top drive coupler 200. For example, the coupler 1204A and/or 1204B may have a similar arrangement to the coupler 204 of the connector 112. To this end the coupler 1204A and/or 1204B may include any of the components used to actuate the coupler 204 into the engaged position including, but not limited to the coil stab, the guide, the outer guide, the coil stab guide, the biasing members, the cables or communication links, and the like. Actuator 1206A may be used to actuate the couplers 1204A and/or 1204B independently of the pipe portion 1220 or the top drive portion 1222. Further, any number of actuators 1206B may be used to actuate the couplers 1204A and 1204B independently of the pipe portion 1220 or the top drive portion 1222.

The tube connector 1112 may be configured to allow fluid flow through the body 1212 of the connector 1112. The tube connector 1112 may have a central bore 1205 for fluid flow therethrough. Further, any of the components of the internal components of the body 1212 may be configured to allow flow past the components. For example, the coil stab 1600 used to actuate the couplers 1204A and 1204B may have a coil stab bore 1605 configured to allow flow through the coil stab 1600. The flow path defined by the central bore 1205, and/or coil stab bore 1605, may allow the operator and/or controller 114 to pump fluids into the drill string 132 when the top drive 134 is disconnected from the uppermost pipe 133 and the uppermost pipe 133 is supported from the elevator 126. The fluids may be any fluids used during drilling operation including, but not limited to drilling mud, cement, stimulation treatment fluid and the like.

Figure 12C:
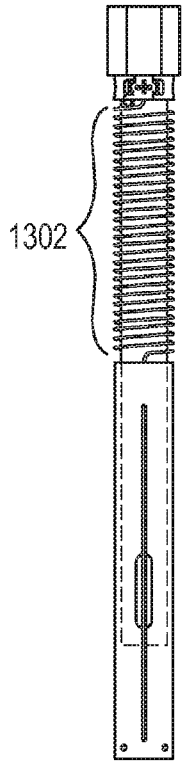
FIG. 12C shows a coiled wire for use with the tube connector.

The communication link 1302 between the couplers 1204A and 1204B may be any suitable communication link, and/or cable, including any of the communication links described herein. When the top drive coupler 200 is in communication with the coupler 1204B and the transducer 130 is in communication with the coupler 1204A, the controller 114 may communicate with the drill string 132 through the top drive 134 and the connector 1112. Because the body 1212 may have a telescoping form, it should be appreciated that the communication line 1302 may include an expansion device 1304. The expansion device 1304 allows the cable 1302 to extend and/or retract its linear length during the extension and/or retraction of the body 1212. As shown in FIG. 12B, the expansion device is a coiled wire. The coiled wire simply wraps around a diameter of the body 1212. When the body 1212 is extended linearly, the distance between the loops of the coil may expand thereby extending the overall linear length of the communication line 1302 with the body 1212, in the similar manner a coiled telephone cord expands and contracts. The expansion device 1304 may be a coiled wire expansion device 1162 as shown in FIG. 12C. The coiled wire expansion device is similar to an expansion devices used in a jar, such as the jar in U.S. Pat. No. 6,991,035 which is hereby incorporated by reference. Although the expansion device 1304 is described as a coiled wire, it should be appreciated that any method of linearly expanding the communication line 1302 may be used.

Although the tube connector 1112 only requires connection to the top drive coupler 200 to communicate with the controller 114, it should be appreciated that a separate cable 1118 may communicate with the tube connector 1112 independent of the need to establish a communication link with the top drive coupler 200. Thus, if fluid communication is not required, the operator and/or the controller 114 may engage the coupler 1204A with the transducer 130 in order to establish communication with the drill string 132 without engaging the coupler 1204B with the top drive coupler 200.

Figure 13:
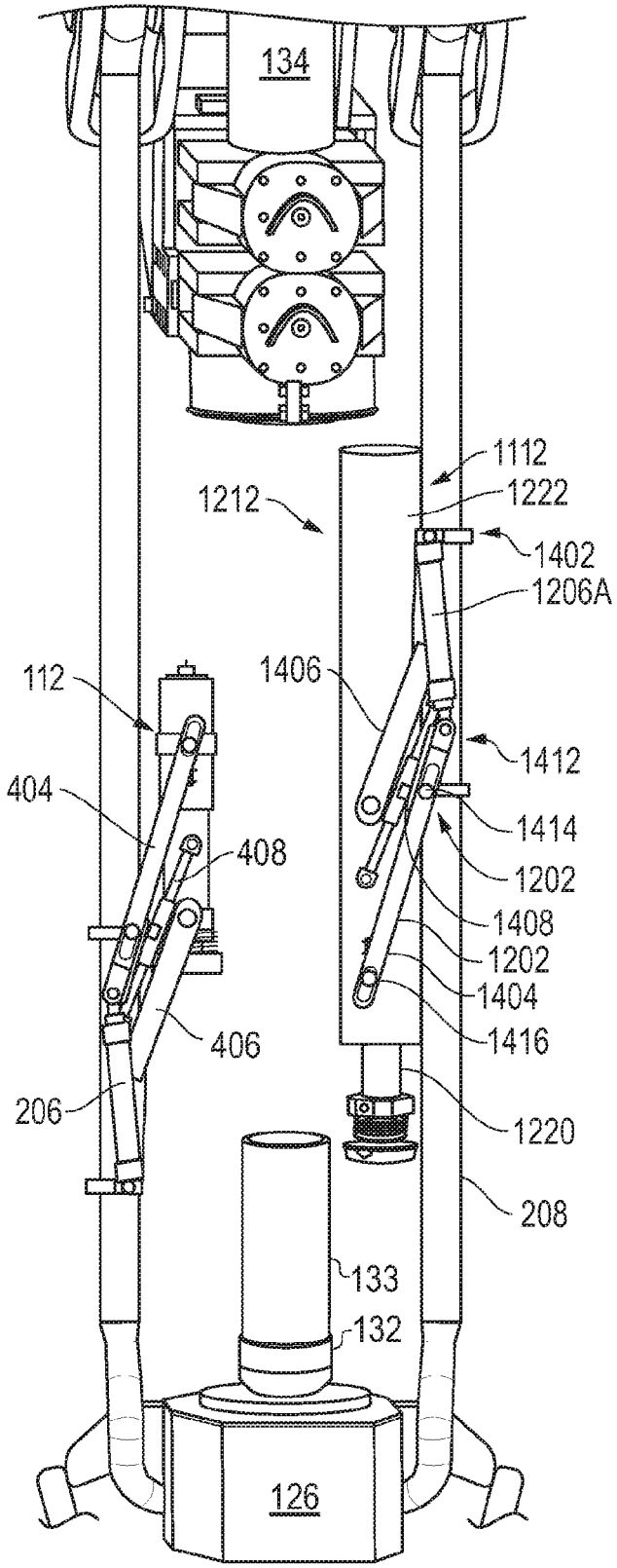
FIG. 13 is a detailed view of a portion of the wellsite of FIG. 2 depicting the stab connector and the tube connector supported on the surface handling system in the disengaged positions.

FIG. 13 is a perspective view of the top drive 134 having the stab connector 112 for communicating with the drill string 132 only and the tube connector 1112 for communicating with the drill string 132 and/or the top drive 134. The connectors 112 and 1112 are shown in the disengaged position. The connectors 112 and 1112 are shown as being coupled to the elevator bails 208. However, it should be appreciated that the connectors may couple to any component so long as the connectors 112 and 1112 may move between the engaged and disengaged positions. Although both connectors are shown, it should be appreciated that either connector 112 or 1112 may be absent. For the following discussion only connector 1112 will be discussed.

The frame 1202 of the connector 1112 may be similar to the frame described above. The frame 1202 may include an elevator bail connector 1402. The elevator bail connector 1402 may be similar to the elevator bail connector described above. Thus, the frame 1202 may have the actuator arm 1404, the guide arm 1406 and the alignment arm 1408. The actuator arm 1404 may operate in a similar manner as the actuator arm 404. Thus, the actuator arm 1404 may include the actuator end 1412, an arm connector 1414, and a body end 1416. The guide arms 1406 and the alignment arm 1408 may also include the arm connector 1414 and the body end 1416. The actuator end 1412, the arm connector 1414, and the body end 1426 for the arms 1404, 1406, and 1408, may operate in a similar manner as the components of the arms 404, 406 and 408 described above. The guide arm 1406 and the alignment arm 1408 may align the body 1212 of the connector 1112 with the linear axis of the top drive 134 and/or the drill string 132 in a similar manner as the guide arm 406 and the alignment arm 408 described above. Further, any of the techniques described to adjust the axial alignment, and/or the distance from the elevator bail 208 to the centerline of the drill string 132 may be used to adjust the position of the body 1212.

Figure 14:
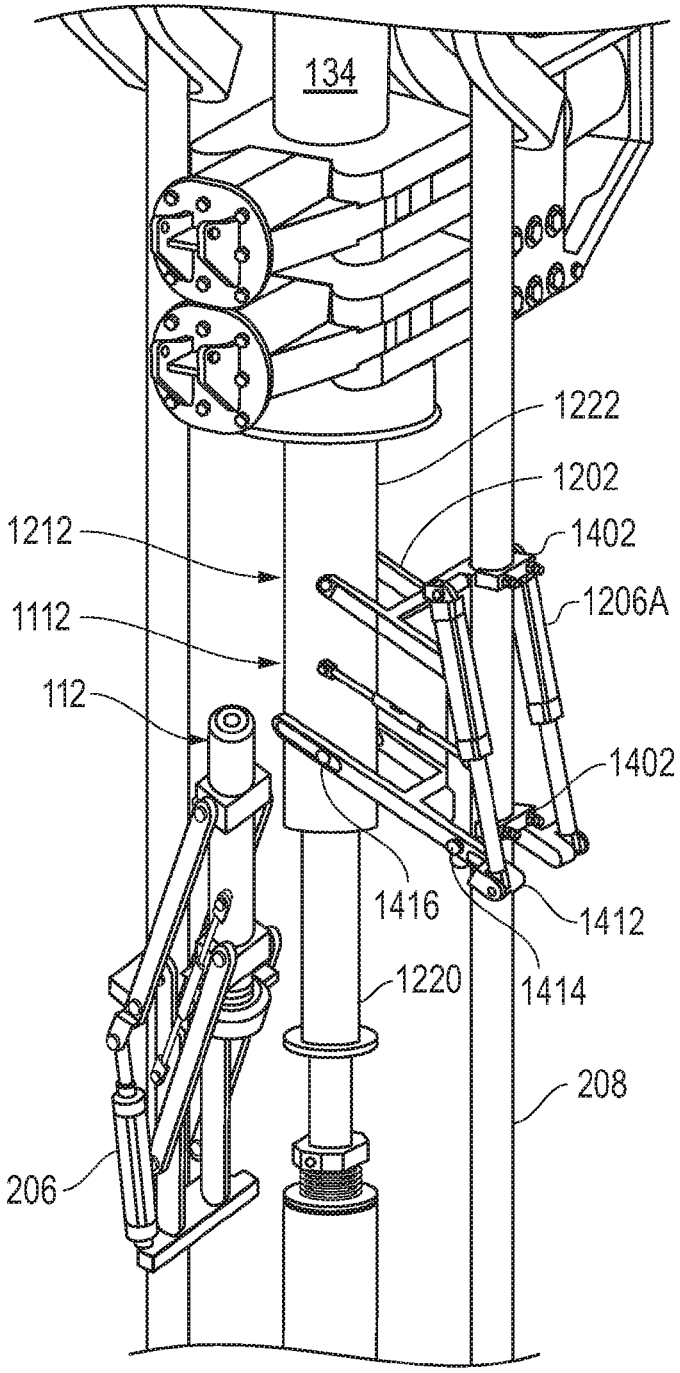
FIG. 14 is a schematic view of the portion of the wellsite of FIG. 2 with the tube connector in the engaged position and the stab connector in a disengaged position.
Figure 15:
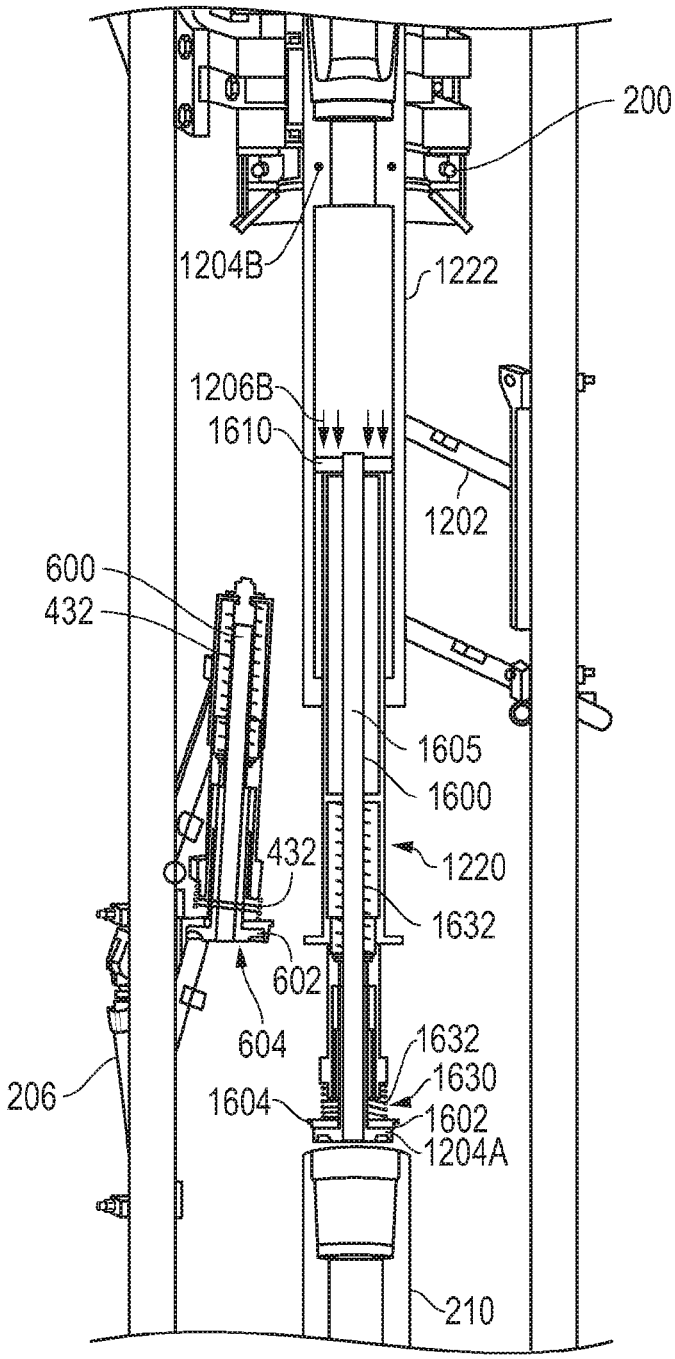
FIG. 15 is a cross-sectional view of the portion of the wellsite of FIG. 14 taken along line 15-15.

The actuator 1206A is shown as pushing the actuator end 1412 in a direction toward the box end 210 of the uppermost drill pipe 133, thus moving the body 1212 toward the top drive 134. Thus, as the actuator 1206 moves the body 1212 toward the engaged position as shown in FIG. 14, the body 1212 moves up and into linear alignment and/or engagement with the top drive 134. A top drive portion 1222 of the body 1212 may be moved by the actuator 1206A into engagement with the top drive 134 and/or in communication with the top drive coupler 200 (as shown in FIG. 15) by the actuator 1206A. Thus, the coupler 1204B may be integral with or operatively coupled to the top drive portion 1222 as shown in FIG. 15. Thus, the actuator 1206A may engage the coupler 1204B, as shown in FIGS. 12B, 14, and 15, into communication with the top drive coupler 200 by moving the top drive portion 1222. With the top drive coupler 200 in communication with the coupler 1204B, the top drive 134, and/or the controller 114 may communicate with the connector 1112 in a similar manner as described above.

Further, the actuator 1206A may be configured in a similar manner as the actuator 206. Thus, the actuator 1206A may, in addition to moving the body 1212 into linear alignment with the top drive 134, actuate the coupler 1204B in a similar manner as the coupler 204 is actuated. To this end, the top drive portion 1222 of the body 1212 may include any of the components described above in conjunction with the body 212.

With the top drive 134 engaged with the top drive portion 1222 of the body 1212, the pipe portion 1220 of the body 1212 may be communicatively coupled to the transducer 130. As shown in FIG. 15, the pipe portion 1220 of the body 1212 includes several of the features described above for actuating the coupler 204. Thus, the pipe portion 1220 may include a coil stab 1600, an outer guide stab 1602, a coupler stab 1604, one or more biasing members 1632 and the coupler 1204A. As shown, the coil stab 1600, the one or more biasing members 1632, the outer guide stab 1602 and the coupler stab 1604 operate in a similar manner as the coil stab 602, the biasing members 432, the coupler stab 604 and the outer guide stab 602 described above. The coil stab 1600 may be actuated by the actuator 1206B, which is shown as fluid pressure applied to a piston 1610 of the coil stab 1600. The fluid pressure may be applied by fluid flow through the top drive 134 and against the piston 1610. The central bore 1605 of the coil stab 1600 may be designed to allow flow through the body 1212. However, the orifice of the bore may be sized to both apply pressure to the piston 1610 and allow fluid flow at certain flow rates. Although the actuator 1206B is described as fluid pressure supplied by the top drive 134, it should be appreciated that the actuator 1206B may be any actuator suitable for moving the coupler 1204A into engagement with the transducer 130 including, but not limited to, a separate piston and cylinder coupled to the body, a servo, a separate piston and cylinder coupled to an arm in a similar manner as the actuator 1206A and actuator arm 1404, and the like.

With the couplers 1204A and 1204B engaged with the transducer 130 and the top drive coupler 200, respectively, the controller 114 may communicate with the drill string 132 and/or the downhole tools in a similar manner as described herein.

The downhole tools 104 (as shown in FIG. 1) may be powered by batteries, a downhole generator, and/or a power supply at the surface. The downhole generator may require fluid flow downhole to generate power. Using the tube connector 1112 (as shown in FIG. 12A) allows the handling system to flow fluid into the drill string and communicate with the drill string while the drill string is supported by the elevator 125. Thus, the fluid flow may power the downhole tools via the generator thereby allowing the connector 1112 to communicate with the downhole tools 104. Thus, downhole measurements may be obtained from the downhole tools 104 that require fluid flow power generation while tripping the drill string into or out of the wellbore.

During tripping of the drill string a swab pressure may be created. The swab pressure is created by suction caused by the drill string leaving the wellbore. The swab pressure or underpressure has a negative impact on the wellbore quality. The connector 1112, as shown in FIG. 12A, may be used to eliminate, or reduce, swab pressure during tripping by pumping fluids into the drill string as the drill string is pulled from the wellbore. The connector 1112 allows for the elimination of the swab pressure without the time consuming connection of the top drive. The required flow rate of fluid through the connector 1112 and into the drill string to overcome the swab pressure may be determined using the downhole pressure sensors, or gauges. For example, the downhole pressure gauges may be an annular pressure gauge that measures the hydrostatic pressure in real time. Therefore, the connector 1112 allows the bottomhole pressure to be maintained at a substantially constant pressure to preserve the wellbore quality.

The connector 1112 may be used to manage pressure in the wellbore in order to maintain a substantially constant bottom hole pressure (BHP). The connector 1112 may be used in conjunction with a back pressure system comprising a pump, an annular seal 2000, and a choke 2002 as shown in FIG. 1. The back pressure system typically maintains the bottom hole pressure by pumping fluids into the annulus between the drill string and the wellbore and restricting the fluid flow from the well with an annular seal 2000 and the choke 2002. The connector 1112 enables the application of surface back-pressure by pumping thru the connector 1112 and into the drill string. The existing back pressure system may allow for additional pressure control. With the ability of the connector 1112 to measure in real time the hydrostatic pressure (and therefore the BHP), the exact amount of required backpressure may be determined while tripping. Further, the choke could automatically be controlled in a closed loop fashion.

Downhole parameters described herein may be any parameter of the downhole system. The downhole parameters may comprise downhole mechanical drilling tool parameters, fluid parameters, reservoir parameters, formation parameters, and downhole conditions such as downhole pressure, bottom hole pressure, pressure in the drill string, pressure in the annulus between the drill string and the wellbore, strain in the drill string, compression in the drill string, tension in the drill string, hydrodynamic pressure, reservoir pressure, formation parameters, and reservoir fluid parameters, among others.

Downhole operations described herein may be any operation performed downhole such as measuring, monitoring, producing, and/or determining one or more downhole parameters of the wellbore. The downhole operations may be performed by the downhole tools 104, as shown in FIG. 1, and/or any other tool and/or system for performing downhole operations. For example, the downhole operations may comprise monitoring strain in the drill string, measuring pressure, performing telemetry, measuring downhole formations, and the like.

Figure 16:
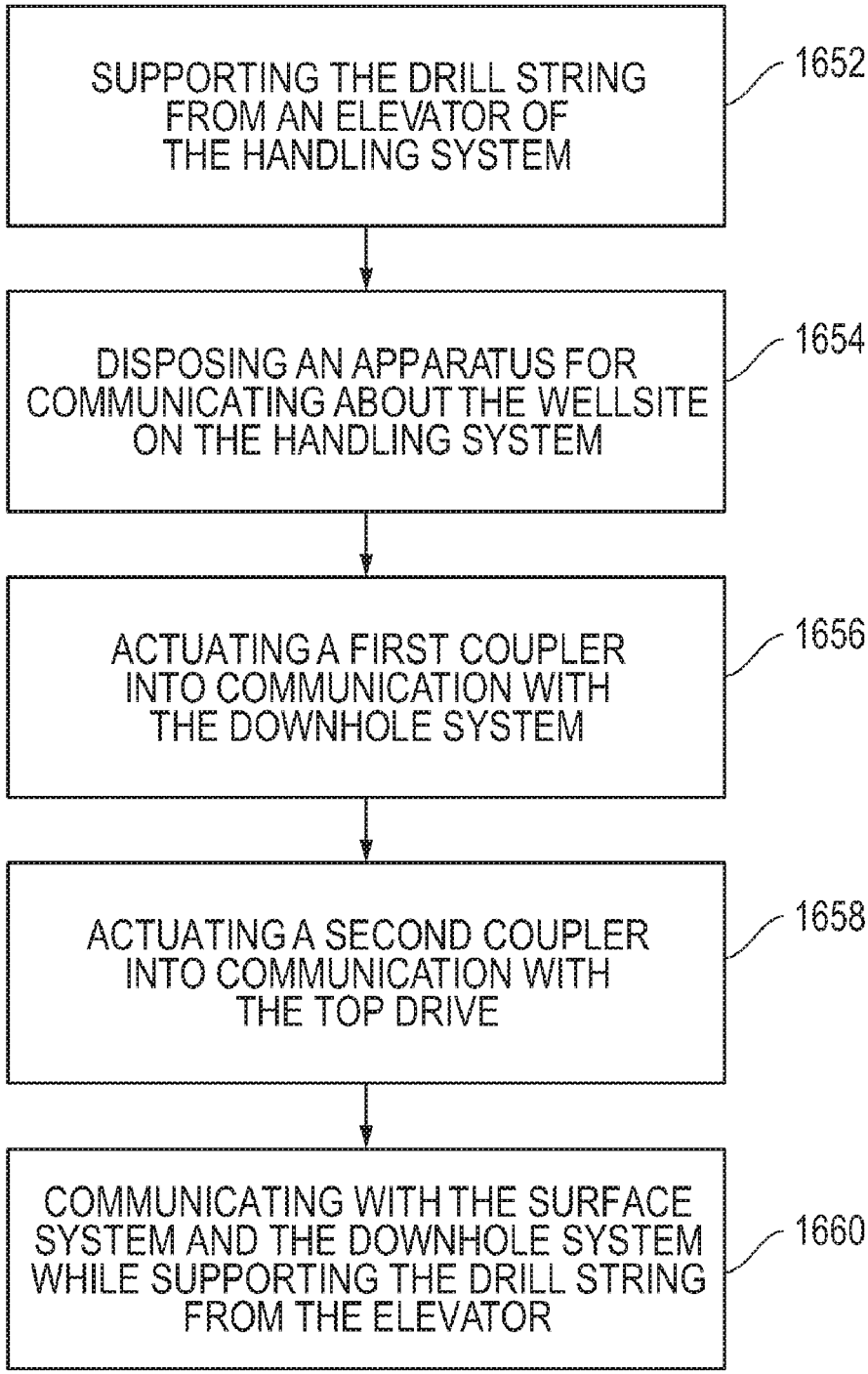
FIG. 16 is a flow chart illustrating another method communicating about a wellsite.

FIG. 16 is a flowchart 1650 depicting an alternate method of communicating about a wellsite. The method includes supporting 1652 a drill string from an elevator of a handling system. Disposing 1654 an apparatus, or tube connector for communicating about the wellsite on the handling system. The method further includes actuating 1656 a first coupler into communication with the downhole system. The method further includes actuating 1658 a second coupler into communication with the top drive. The method further includes communicating 1660 with the drill string through the connector while the surface system and the downhole system while supporting the drill string from the elevator. The method may further include flowing a fluid through the connector and into the drill string. The method may optionally include determining a downhole pressure while tripping the drill string into and out of the wellbore.

The drill string may be supported by the elevator during drilling operations such as tripping. The controller and/or operator may determine a need to communicate with the drill string and/or downhole tools coupled to the drill string. The controller may move the connector 112, as shown in FIG. 13, from the disengaged position to the engaged position in order to communicate with the drill string 132. If operator and/or controller 114 (as shown in FIG. 1) determine that it may be desired to communicate through the top drive, and/or flow fluid into the drill string 132, the controller 114 may move connector 112 from the engaged position to the disengaged position. The controller 114 may then move the connector 1112 into the engaged position whereby the connector 1112 is in communication with both the top drive 134 and the drill string 132. The controller 114 and/or the operator may then communicate with the drill string 132 via the top drive 134 through the connector 1112. The controller may further flow fluid through the connector 1112 and into the drill string 132.

It will be appreciated by those skilled in the art that the systems/techniques disclosed herein can be fully automated/autonomous via software configured with algorithms to perform operations as described herein. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a magnetic tape; a read-only memory chip (ROM); and other forms of the kind well-known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the disclosure may also be configured to perform the described computing/automation functions downhole (via appropriate hardware/software implemented in the network/string), at surface, in combination, and/or remotely via wireless links tied to the network. Advantages provided by the present disclosure may include, for example, improved safety by reducing the number of people required on the rig floor. Field technicians typically operate a handheld device that they screw into the pipe when suspended in the slips to 'spot check' the network for connectivity. Many times, their presence at the rotary table obstructs the rig crews. With aspects of the disclosure mounted on the rig equipment (e.g., on the bails), there may be no need for technicians to be on the rig floor, thereby reducing the chance for crew injuries or obstructions to the rig crews. Improved downhole measurement availability while tripping is also provided. This may allow for the following:

- Dynamic downhole hydrostatic pressure measurements in real time while tripping, revealing accurately the dynamic surge and swap pressures. These pressures are generally not available in real time and wellsite personnel rely on conservative rules of thumb or on mathematical models instead of accurate measurements. Surge pressure could result in time-consuming lost circulation events, while swap pressure could lead to dangerous or costly well control events. Closed loop feedback is now possible with the drawworks controlling the trip speed in an optimum operating range, based on the downhole pressure measurements in real time.
- Downhole strain measurements on the drill string can now be measured in real time while the string is moving in lateral direction. This allows for measuring the compression or tension stresses on downhole equipment at different positions in the drill string. Closed loop feedback is now possible by controlling the drawwork speed based on the acting compression/tension stress measurements in an optimum range.
- Without the time consuming practice to engage the top drive, now multipass, time lapse or repeat measurements can be made. This is useful to qualify the wellbore and compare the measurements with those at an initial time.
- Repeat measurements of the inclination and azimuth will reduce uncertainty in well placement by averaging out the abundance of measurements acquired at the same point in the wellbore
- Reduction in the number of trips into the hole only to find out at a later time at a greater depth that some component has failed. With measurements all the time during the trip in, infant tool failure rates will be reduced.
- Stuck pipe prevention: In horizontal and especially in ERD wells, trouble frequently originates while tripping. For example, mechanically getting stuck by pulling the drill string into unstable cutting beds that resulted from poor hole cleaning.
- The acquisition of real-time distributed downhole measurements, drill string dynamics analysis, manual/automated adjustment of downhole tools, while tripping.

While the present disclosure describes specific aspects of the invention, numerous modifications and variations will become apparent to those skilled in the art after studying the disclosure, including use of equivalent functional and/or structural substitutes for elements described herein. For example, aspects of the invention can also be implemented for operation in combination with other known telemetry systems (e.g., mud pulse, fiber-optics, wireline systems, etc.). All such similar variations apparent to those skilled in the art are deemed to be within the scope of the disclosure as defined by the appended claims.

While the embodiments are described with reference to various implementations and exploitations, it will be understood that these embodiments are illustrative and that the scope of the inventive subject matter is not limited to them.

Many variations, modifications, additions and improvements are possible. For example, additional sources and/or receivers may be located about the wellbore to perform seismic operations.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An apparatus for communicating about a wellsite having a surface system and a downhole system, the surface system comprising a rig with a handling system, the handling system having a top drive, the downhole system comprising a downhole tool advanced into the earth on a drill string, the drill string comprising a plurality of wired drill pipe, an uppermost drill pipe of the plurality of wired drill pipe being supported by the handling system, the apparatus comprising:

a first coupler operatively connectable to the uppermost drill pipe for communication therewith;

a second coupler operatively connectable to the top drive and the first coupler for communication therebetween;

a frame for supporting the first coupler and the second coupler, the frame operatively connectable to the handling system; and an actuator for moving the frame with the first coupler and the second coupler between an engaged position operatively connecting the first coupler to the uppermost drill pipe of the downhole system and operatively connecting the second coupler to the top drive of the handling system and a disengaged position a distance from the uppermost drill pipe whereby the first coupler and the second coupler selectively establish a communication link between the surface system and the downhole system.

2. The apparatus of claim 1, wherein the first coupler and the second coupler may establish the communication link during tripping.

3. The apparatus of claim 1, wherein the frame further comprises an elevator bail connector, for coupling the frame to an elevator bail of the handling system.

4. The apparatus of claim 1, wherein the frame further comprises at least two arms for moving and guiding the first coupler and the second coupler into the engaged position.

5. The apparatus of claim 4, further comprising a body operatively coupled to the frame, the first coupler and the second coupler positioned in the body, the body having two portions that operate in a telescoping manner.

6. The apparatus of claim 5, wherein the body further comprises at least one coil stab for moving at least one of the couplers into the engaged position.

7. The apparatus of claim 1, further comprising a guide for aligning the first coupler into connection with the uppermost drill pipe.

8. A system for communicating about a wellsite, the system comprising:

a surface system at the wellsite, the surface system comprising a rig and a handling system, the handling system having a top drive;

a downhole system at the wellsite, the downhole system comprising a downhole tool advanced into the earth on a drill string, the drill string comprising a plurality of wired drill pipe, an uppermost drill pipe of the plurality of wired drill pipe being supported by the handling system; and an apparatus for communicating about the wellsite, the apparatus comprising:

a first coupler operatively connectable to the uppermost drill pipe for communication therewith;

a second coupler operatively connectable to the top drive and the first coupler for communication therebetween;

a frame for supporting the first coupler and the second coupler, the frame operatively connectable to the handling system; and an actuator for moving the frame with the first coupler and the second coupler between an engaged position operatively connecting the first coupler to the uppermost drill pipe of the downhole system and operatively connecting the second coupler to the top drive of the handling system and a disengaged position a distance from the uppermost drill pipe whereby the first coupler and the second coupler selectively establishes a communication link between the surface system and the downhole system.

9. The system of claim 8, wherein the top drive may communicatively engage the drill string when the couplers are in the disengaged position.

10. The system of claim 8, wherein the frame further comprises an elevator bail connector, for coupling the frame to an elevator bail of the handling system.

11. The system of claim 8, further comprising a controller for communicatively coupling the apparatus to the downhole system and the surface system.

12. The system of claim 11, wherein the downhole system is in communication with the controller when the coupler is in the engaged position.

13. The system of claim 8, wherein the frame further comprises an actuator arm and a guide arm for moving and guiding at least one of the couplers into the engaged position.

14. A method for communicating about a wellsite, the wellsite having a surface system and a downhole system, the surface system comprising a rig and a handling system, the handling system having a top drive, the downhole system comprising a downhole tool advanced into the earth on a drill string, the drill string comprising a plurality of wired drill pipe, an uppermost drill pipe of the plurality of wired drill pipe being supported by the handling system, the method comprising:

supporting the drill string from an elevator of the handling system;

disposing an apparatus for communicating about the wellsite on the handling system, the apparatus comprising:

a first coupler operatively connectable to the uppermost drill pipe for communication therewith;

a second coupler operatively connectable to the top drive and the first coupler for communication therebetween;

a frame for supporting the first coupler and the second coupler, the frame operatively connectable to the handling system; and an actuator for moving the frame with the first coupler and the second coupler between an engaged position operatively connecting the first coupler to the uppermost drill pipe of the downhole system and operatively connecting the second coupler to the top drive of the handling system and a disengaged position a distance from the uppermost drill pipe whereby the first coupler and the second coupler selectively establishes a communication link between the surface system and the downhole system;

actuating the first coupler into communication with the downhole system;

actuating the second coupler into communication with the top drive; and communicating with the surface system and the downhole system while supporting the drill string from the elevator.

15. The method of claim 14, further comprising disconnecting the first coupler from communication with the downhole system and disconnecting the second coupler from communication with the top drive.

16. The method of claim 15, further comprising engaging the uppermost drill pipe with the top drive.

17. The method of claim 16, further comprising establishing communication with the downhole system through the top drive.

18. The method of claim 14, further comprising operating the apparatus with controls from the top drive.

19. The method of claim 14, further comprising connecting the frame to an elevator bail of the handling system.

20. The method of claim 14, further comprising flowing fluid from the top drive into the uppermost pipe through the apparatus.

21. The method of claim 14, further comprising monitoring downhole parameters while tripping.

22. The method of claim 21, wherein the downhole parameter is a dynamic hydrostatic pressure.

23. The method of claim 21, wherein the downhole parameter is a drill string strain.

24. A method for communication with a drill string in a wellbore, comprising:

supporting the drill string from an elevator of a handling system;

disposing an apparatus for communicating with the drill string proximate the handling system, wherein the apparatus comprises:

a first coupler operatively connectable to the drill string for communication therewith;

a second coupler operatively connectable to a top drive of the handling system and the first coupler for communication therebetween;

a frame for supporting the first coupler and the second coupler, the frame operatively connectable to the handling system; and an actuator for moving the first coupler to a communicatively engaged position with the drill string;

tripping the drill string out of the wellbore;

flowing fluid into the drill string through the apparatus while tripping; and communicating with the drill string via the coupler while tripping.

25. The method of claim 24, further comprising measuring a downhole parameter while tripping.

26. The method of claim 25, further comprising pumping fluid into the wellbore and thereby maintaining a substantially constant bottom hole pressure while tripping.

27. The method of claim 24, further comprising generating power downhole with the flowing fluid to perform downhole operations.

28. The method of claim 27, further comprising performing a downhole operation with the generated power.

* * * * *